US006726507B1

(12) United States Patent
Simmons et al.

(10) Patent No.: US 6,726,507 B1
(45) Date of Patent: Apr. 27, 2004

(54) COMPLIANT MODULAR JACK

(75) Inventors: Randy Gray Simmons, Lewisville, NC (US); Don Kevin Willis, Winston-Salem, NC (US); Kevin John Peterson, High Point, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/678,516

(22) Filed: Oct. 3, 2000

Related U.S. Application Data

(60) Provisional application No. 60/172,400, filed on Dec. 17, 1999.

(51) Int. Cl.[7] ..... H01K 24/00

(52) U.S. Cl. ..... 439/676; 439/946

(58) Field of Search ..... 439/676, 946, 439/76.1, 329, 64, 59, 60, 61, 62, 636, 637, 631, 632, 79

(56) References Cited

U.S. PATENT DOCUMENTS 4,566,749 A * 1/1986 Johnston ..... 439/441
4,602,842 A 7/1986 Free et al. ..... 339/156 R
4,647,136 A * 3/1987 Kinoshita et al. ..... 439/571
5,773,332 A 6/1998 Glad ..... 439/344
5,940,275 A 8/1999 Laity ..... 361/737
5,971,775 A * 10/1999 Tor et al. ..... 439/79
5,984,731 A 11/1999 Laity ..... 439/676
6,102,714 A * 8/2000 Oliphant et al. ..... 439/131
6,116,962 A * 9/2000 Laity ..... 439/676

* cited by examiner

*Primary Examiner*—Ross Gushi

(57) ABSTRACT

A modular jack connector assembly comprising: (a) a dielectric housing having a front and rear orientation and defining at least one receptacle adapted for receiving a mating plug; and (b) a plurality of contacts disposed in the housing, each contact being secured to the housing at a rear portion thereof, each contact extending forward from the rear portion to a free end such that a portion of the contact electrically connects with a mating plug when the mating plug is received within the receptacle.

33 Claims, 5 Drawing Sheets

COMPLIANT MODULAR JACK

REFERENCE TO RELATED APPLICATION

This application claims the benefit of U.S. Provisional Application No. 60/172,400 filed on Dec. 17, 1999, and incorporated herein by reference.

REFERENCE TO APPENDIX

Attached hereto as Appendix A is Title 47 (Telecommunications), Code of Federal Regulations, Chapter I (Federal Communications Commission), Subchapter B (Common Carrier Services), Part 68 (Connection of Terminal Equipment to the Telephone Network), Subpart F (Connectors), Section 68.500 (1992), herein referred to as the "RJ Standard."

FIELD OF THE INVENTION

This invention relates generally to connectors for electronic communication devices. More specifically, the present invention relates to modular jacks for connecting to telecommunication lines.

BACKGROUND OF THE INVENTION

A vast majority of communication devices, such as telephones, facsimile machines, modems and local area network (LAN) adapters, require a wire connection to a telecommunication line. To conveniently attach a telecommunication line to a communication device, standard connectors have been promulgated. The most popular of these connectors is known in the art as the RJ-xx series of connectors. Of the RJ-xx series of connectors, the RJ-11, the RJ-12 and RJ-45 connectors are widely used. The RJ-11 connector comprises a six-contact plug and a corresponding jack, while the RJ-45 connector comprises an eight-contact plug and a corresponding jack. The RJ-11 and RJ-45 connectors are standardized in the industrial world and have desirable attributes of both low cost and high reliability.

Detailed information regarding the RJ-xx series of connectors can be found at Title 47 (Telecommunications), Code of Federal Regulations, Chapter I (Federal Communications Commission), Subchapter B (Common Carrier Services), Part 68 (Connection of Terminal Equipment to the Telephone Network), Subpart F (Connectors), Section 68.500 (1992) which is incorporated herein by reference in its entirety and referred to herein as "RJ-standards." Among other parameters, the RJ-standards provide for contact configurations having a minimum normal force and particular dimensions.

Although the RJ-standards provide for reliable and standardized connections, the applicants have identified that the relatively stout connectors mandated by the RJ-standard lack sufficient compliance to accommodate normal misuse. Misuse occurs, for example, when a user inserts an RJ-11 plug into an RJ-45 jack. Such an occurrence is not uncommon since these connectors are often used by people unfamiliar with the differences between the various RJ connectors which resemble each other. Such misuse unfortunately results in the housing around the RJ-11 plug permanently deforming the outer contacts of the RJ-45 connector.

The applicants have also identified that the lack of compliance of RJ-standard contacts results in limited durability due to the permanent deformation of the contacts after repeated mating cycles. According to the RJ-standard, a connector is rated only for 750 mating cycles. Although such a number may seem adequate, it is quickly reached by many users who may connect and disconnect their portable computers or other communication devices several times a day, every day, for several years. Indeed, it is not uncommon for a user to put a connector through 2,000 mating cycles or more in the life of the communication device. Thus, the RJ-standard of 750 mating cycles is woefully inadequate.

Therefore, there is a need for a modular jack connection which allows for normal misuse and provides for greater durability. The present invention fulfills this need among others.

BRIEF DESCRIPTION OF DRAWINGS

FIG. 3 is a back perspective view of the modular jack assembly shown in FIG. 1 showing the card edge connector of the modular jack ready for insertion onto a circuit board;

SUMMARY OF INVENTION

Figure 1:
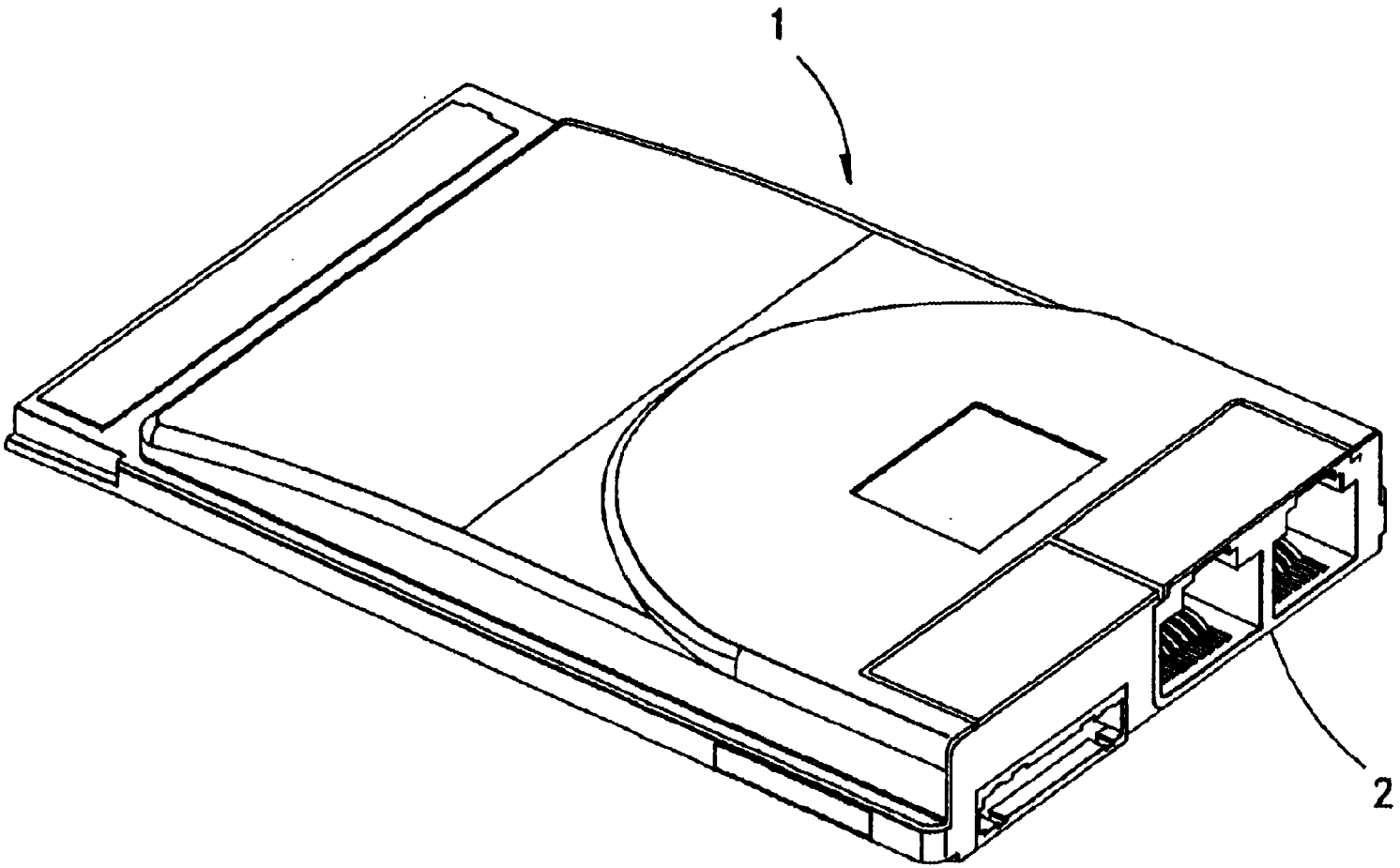
FIG. 1 is a top perspective view of a communication card employing a modular jack assembly of the present invention.

The present invention provides for a modular jack connector which allows for normal misuse and a high number of mating cycles by increasing the compliance of the contacts within the connector. It has been found that contacts with greater compliance tend to be more durable and more forgiving of misuse. To improve compliance, the connector has a novel configuration in which the contacts are anchored toward the back of the connector and extend forward such that their free end is toward the front of the connector. By having the end of the contact near the front of the connector free, the contact can accommodate a great deal of misalignment at the front of the connector where such misalignment is most likely to occur. In addition to having a free front end, the contacts are configured to be more slender than those conforming to RJ-standards, thereby further improving their compliance. Despite deviating from RJ-standards, it has been found that the connectors of the present invention nevertheless provide adequate contact with standard RJ plugs.

Having the rear sections of the contacts secured to the housing also provides for an effective card-edge connector configuration. More specifically, the rear sections of the contacts may be mounted in the housing directly above a card edge-receiving slot to allow the ends of the contacts to extend into the slot. This way, the contact ends make contact with a circuit board when the modular jack assembly is mounted thereon. Such a configuration enables a single contact member to electrically connect the plug to the circuit board thereby eliminating intermediate circuitry and simplifying the modular jack assembly and its connection to the circuit board. Accordingly, this design lowers costs and increases reliability.

Accordingly, one aspect of the invention is a modular jack connector having contacts with high compliance relative to comparable RJ-type connectors. In a preferred embodiment, the connector comprises: (a) a dielectric housing having a front and rear orientation and defining at least one receptacle adapted for receiving a mating plug; and (b) a plurality of contacts disposed in the housing, each contact being secured to a rear portion of the housing, each contact extending forward from the rear portion to a free end such that a portion of the contact electrically connects with a mating plug when the mating plug is received within the receptacle. Preferably, the contacts are configured to provide sufficient compliance such that if an incorrect RJ-standard plug is inserted into the receptacle, the elastic limit of the contacts is not exceeded. To this end, the contacts preferably are thinner and narrower than those conforming to RJ-standards and have a lower normal force than required under the standard.

Another aspect of the invention is a modular connector having a simple card-edge connector interface. In a preferred embodiment, the housing of the connector described above also comprises a slot on the rear end thereof suitable for receiving the edge of a circuit board. Each contact has a connection portion that extends through the housing and into the slot such that, when the housing is mounted to a circuit board, a portion of the connection portion makes contact with the circuit board.

Another aspect of the invention is a PCMCIA card comprising the modular jack connector of the present invention. In a preferred embodiment, the PCMCIA card comprises: (a) a housing; (b) a circuit board mounted in the housing; and (c) a modular jack connector assembly card-edge mounted to the circuit board, the modular jack assembly comprising: (i) a dielectric housing having a front and rear orientation and defining at least one receptacle adapted for receiving a mating plug; and (ii) a plurality of contacts disposed in the housing, each contact being secured to the a rear portion of the housing, each contact extending forward from the rear portion to a free end such that a portion of the contact electrically connects with a mating plug when the mating plug is received within the receptacle.

DETAILED DESCRIPTION OF PREFERRED EMBODIMENT

Referring to the drawings, FIG. 1 shows a top perspective view of a communication card 1 comprising a modular jack assembly 2 of the present invention. It will be evident to those skilled in the art that although the invention is described herein with reference to a communications card and RJ-standard plug configurations, the modular plug of the present invention is not restricted to RJ-type plugs and may be used in any application where a modular connector is connected to a circuit board.

Figure 2:
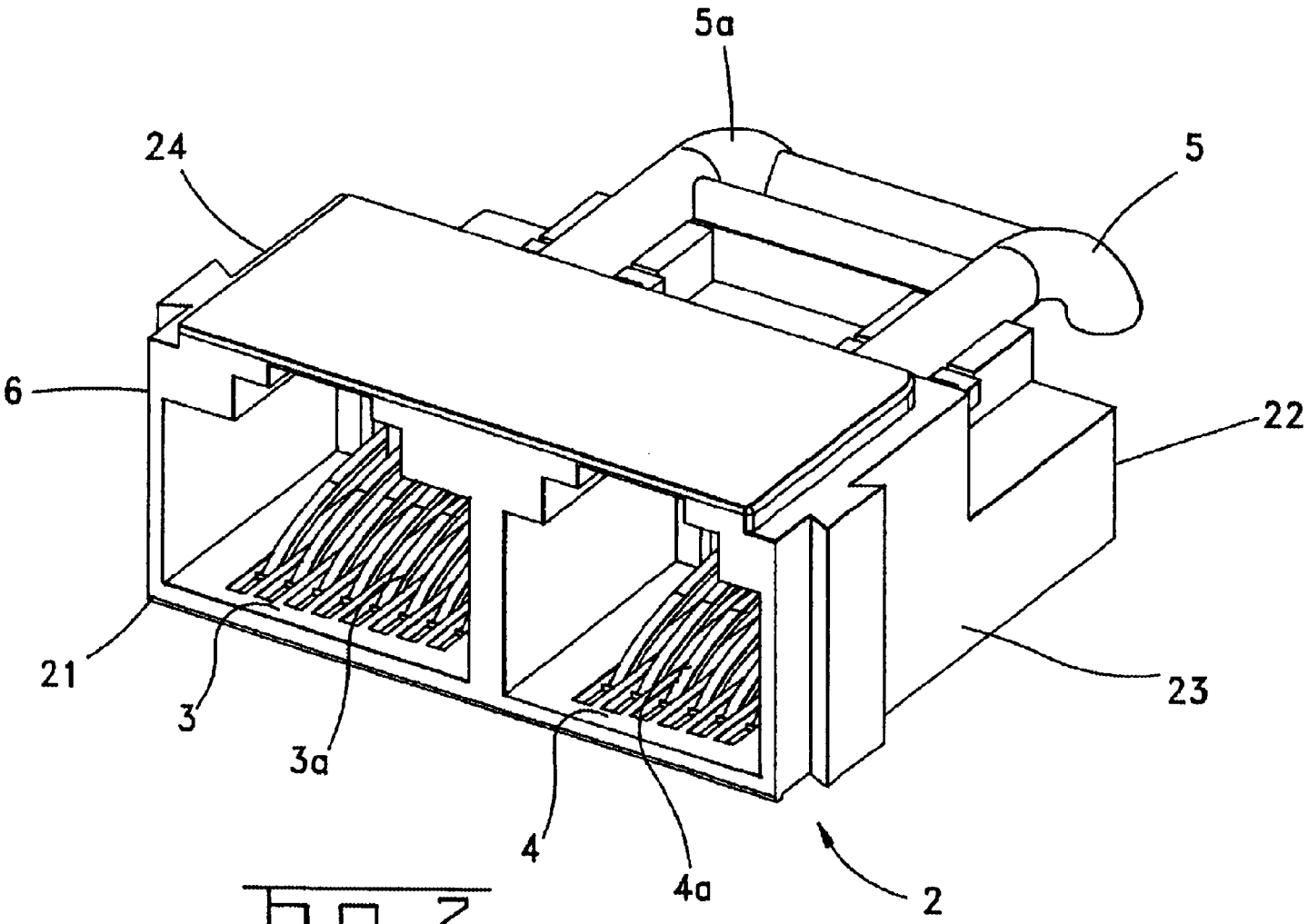
FIG. 2 is a front perspective view of the modular jack assembly shown in FIG. 1.
Figure 7:
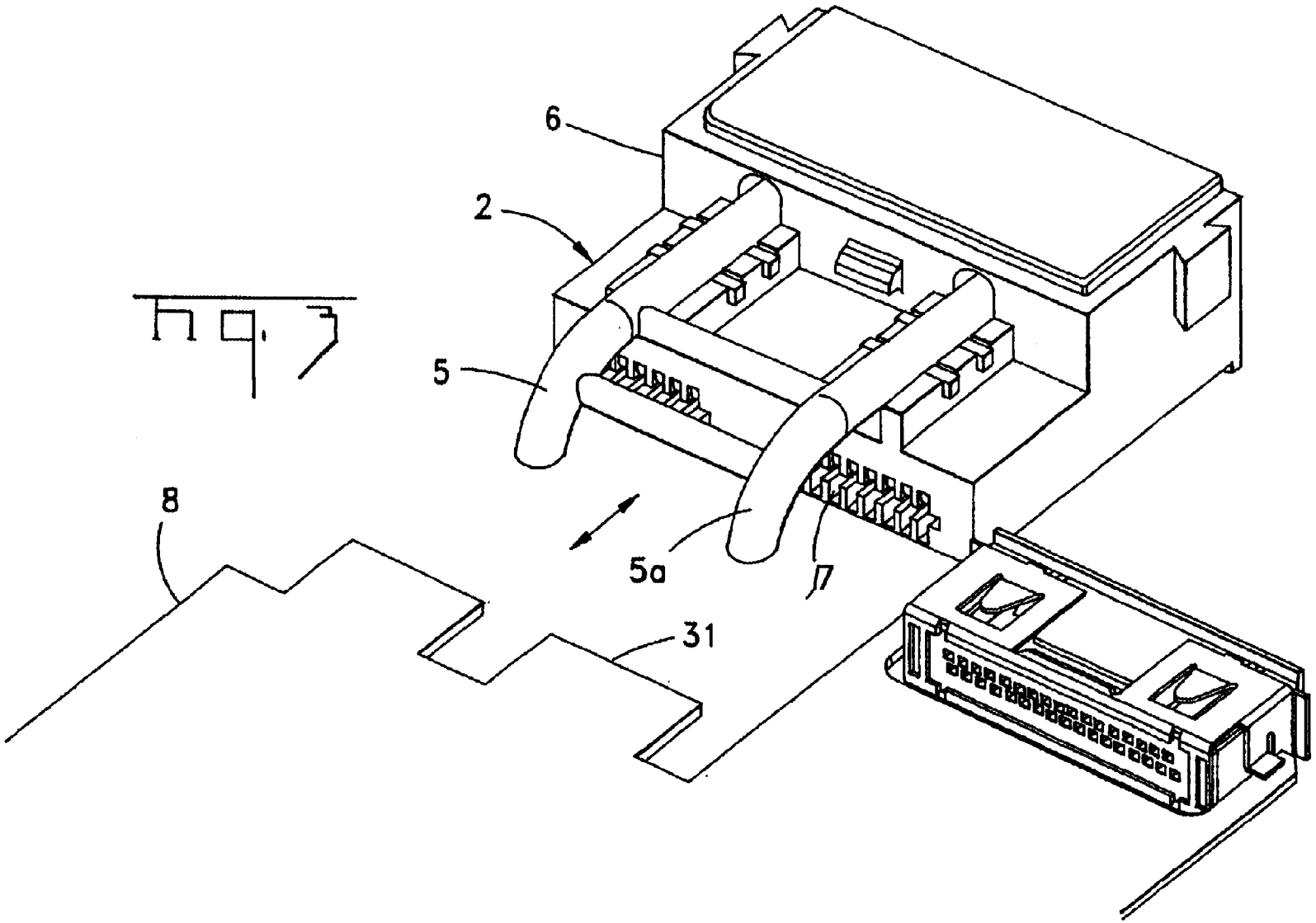

A front perspective view of the connector assembly 2 is shown in FIG. 2. As shown, the modular jack assembly 2 comprises a dielectric housing 6 having receptacles 3 and 4 on the front face thereof. Receptacle 3 is configured to receive an RJ-45 plug, while receptacle 4 is configured to receive an RJ-11 plug. In a preferred embodiment, the modular jack assembly 2 has light pipes 5 and 5*a* extending backward from the rear of the receptacles 3 and 4, respectively. The back ends 20 (only one shown) of light pipes 5 and 5*a* are positioned such that each aligns with an LED on the printed circuit board when the modular jack assembly 2 is mounted on a card to communicate light from the LED to the back of the receptacles. It should be understood that although the modular jack assembly 2 as shown in FIG. 2 integrates two receptacles, the invention covers modular connectors having just one receptacle or two or more receptacles.

Within receptacles 3 and 4 are a plurality of contacts 3*a* and 4*a*, respectively. According to the RJ-standards, the RJ-45 receptacle 3 has eight parallel contacts and the RJ-11 receptacle 4 has six parallel contacts. The shape and positioning of the contacts within the receptacles and even the shape and dimensions of the receptacles themselves is governed by the RJ-standards and thus will not be addressed specifically herein.

Figure 4:
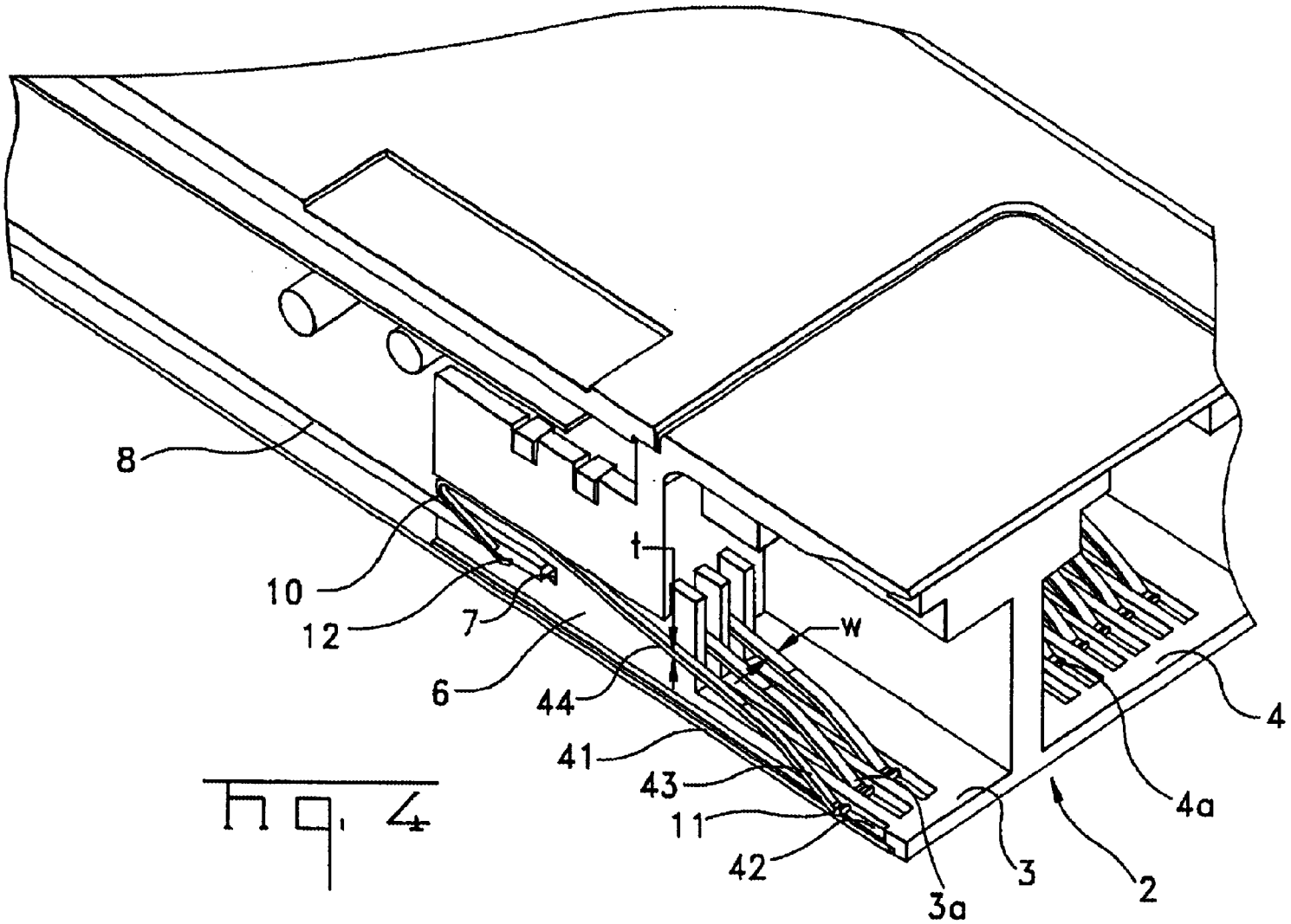
FIG. 4 is a front perspective view of a cross section of the card shown in FIG. 1.
Figure 5:
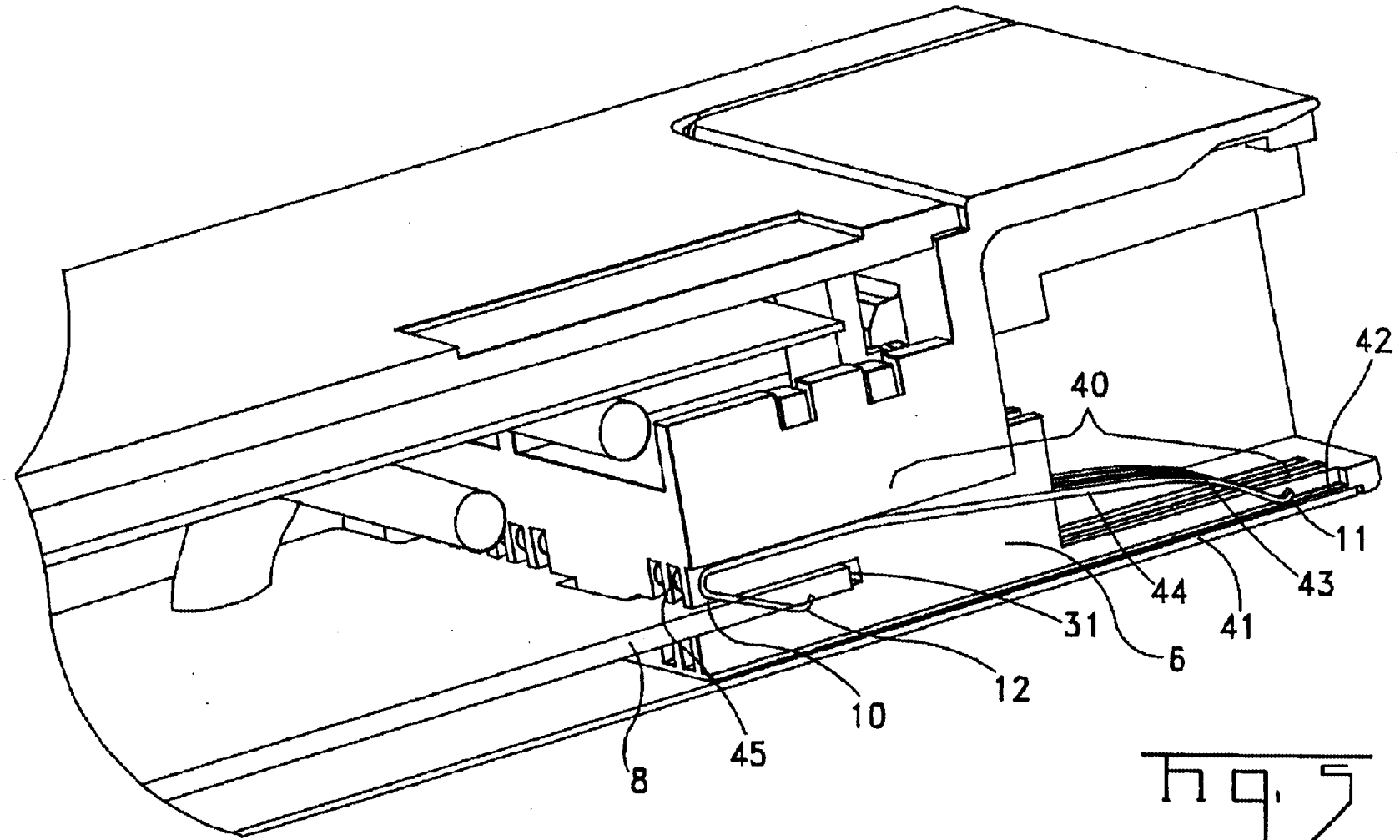
FIG. 5 is a back perspective view of the cross section of the card shown in FIG. 1

FIGS. 4 and 5 show front and back perspective views of a cross-section of the card of FIG. 1 taken through the receptacle 3 and along the length of one of the contacts 3*a*. Each contact comprises a plug-engaging portion 40 and a connection portion 10. The plug-engaging portion 40 is the portion of the contact that is disposed within the receptacle of the modular jack and is preferably flexible such that it deforms or deflects as a modular plug is received within the receptacle. The connection portion 10 of the contact is that portion of the contact that electrically connects the modular jack to the printed circuit board of the communications device.

FIGS. 4 and 5 illustrate an important feature of the present invention, namely that the contacts 3*a* and 4*a* are secured to the rear of the housing 6 and extend forward to a free end 11. This provides for greater compliance at the front of the receptacle which is where greater misalignment is likely to occur between the receptacle and the mating plug.

These figures also illustrate another feature of the present invention, namely, the card edge connector of the modular jack assembly 2. More specifically, contacts 3*a* and 4*a* are secured to the housing 6 directly above a card edge-receiving slot 7 to allow the connection portions 10 of contacts 3*a* and 4*a* to extend into the slot. In this way, as shown in FIG. 4, portions 12 of the connection portions 10 make contact with pads (not shown) of circuit board 8 (which is enclosed in the PCMCIA card 1 shown in FIG. 1) when the modular jack assembly 2 is mounted thereon. In other words, the combination of the slot 7 and connection portions 10 of contacts 3*a* and 4*a* cooperate to act as a card edge connector suitable for receiving and electrically connecting with the edge 31 of circuit board 8. Such a configuration enables a single contact member to electrically connect the plug to the circuit board thereby eliminating intermediate circuitry and simplifying the modular jack assembly and its connection to the circuit board.

With reference to the specific embodiment of the invention shown in FIGS. 4 and 5, the free end 11 of the plug-engaging portion 40 of the contact is positioned within a slot 42 in the lower wall 41 of the receptacle. The free end 11 is connected to an upwardly angled section 43 that is positioned to engage with the modular plug when received within the receptacle. The upwardly angled section 43 is about 4 mm in length and extends from the free end 11 at an angle of about 30 to 45 degrees from the lower wall 41. An elongated arm portion 44 is connected to the upwardly angled section 43. The elongated arm portion 44 is about 10.0 mm long and extends from the upwardly angled section 43 at an upward angle of between about 5 and 15 degrees from the lower wall 41. The elongated arm portion 44 is connected to the connection portion 10 of the contact. The connection portion 10 is anchored along a rear portion 45 of housing 6. The connection portion 10 is curved around the rear portion 45 to anchor or otherwise secure the contact to the housing. Preferably, the connection portion 10 extends into the slot 7 to a free end 12. The free end 12 resiliently engages an electrical contact such as a pad on the top surface of the circuit board 8 when the board edge is received within the slot.

Although not evident from the figures, the contacts 3*a* and 4*a* of the present invention are more compliant than RJ-standard contacts, not only because they have a free forward end 11, but also because they preferably are more slender than standard RJ contacts. For purposes of describing the dimensions of the contacts of the present invention to those of the RJ-standard, reference is made to the thickness t and width w of the contacts as shown in FIG. 4. In the preferred embodiment, the thickness is about 25% to about 75% less than the applicable RJ-standard, and, more preferably, about 50% less, while the width is about 5% to about 15% less than the applicable RJ-standard, and, more preferably, about 10–12% less. For example, in an RJ-11- or RJ-45-style connector, it has been found that contacts with a thickness of about 0.005" to about 0.014" and a width of about 0.014" to about 0.016" are effective, and, for optimum compliance, a thickness of about 0.009" and a width of about 0.015" is preferred.

Because the contacts are less substantial than their RJ counterparts, a reduced normal force is also observed. Given the length, width and thickness of the contacts of the present invention, a normal force of less than about 25% to 80% of the applicable RJ-standard is preferred, and a normal force of about 65% of the applicable RJ-standard is more preferred. For example, it has been found that a contact having a normal force of about 30 g to about 50 g is effective, and, for optimum compliance, a contact having a normal force of about 35 g is preferred.

Despite deviations from the RJ standard, applicants have found that the performance of the contacts does not suffer. Indeed, as a result of being more compliant, the modular jack connectors of the present invention are rated for significantly more connections than are their RJ-standard counterparts. In a preferred embodiment, the connectors of the present invention are rated for at least about 1000 mating cycles, more preferably, for at least about 2000 mating cycles and, even more preferably, for at least about 3,000 mating cycles.

The compliance is sufficient such that if an RJ-11 plug is mistakenly inserted into an RJ-45 receptacle, the outer two contacts of the RJ-45 receptacle are not bent beyond their elastic limit. Consequently, when the mistake is noted and the RJ-11 plug is withdrawn, the outer two contacts of the RJ-45 receptacle return back to their normal, unmated position, without damage.

Appendix A

Subpart F—Connectors

SOURCE: 41 FR 28699, July 12, 1976, unless otherwise noted.

§ 68.500 Specifications.

*General.* The US customary units are shown in parentheses throughout this subpart F. US customary units were the original dimensional units used in designing the plugs and jacks shown in the following pages. The dimensions shown without parenthesis are in SI units. The SI dimensional units are derived from the US customary units by multiplying "inches" by "25.4" to derive the exact conversion in millimeters with no rounding-off of the resulting decimal value. The number of decimal places to which the conversion is taken by adding a particular number of zeroes to the right end of the resulting SI value, where required, is governed by the concept that when the calculated SI dimensional unit is divided by "25.4," the resulting "inches" calculation will be exactly that shown in the parenthesis (the original design dimension). The conversion to SI force units, newtons, is rounded off to a number of decimal places that will result in the calculated SI force value being within less than one percent of the original US customary force unit value located adjacent in parenthesis (the original design value). The rationale for this is that this ill bring the force conversions to within the degree of accuracy of the force-measuring device and avoid the carrying of an unrealistic number of decimal places which would otherwise result from an exact conversion. The plugs and jacks described in this section represent the standard connections to be used for connections to the telephone network. The plug and jack designs shown are representative of generic types, and should not be interpreted as the only designs that may be used. Design innovation and improvement is expected; but for interchangeability to be maintained, alternative designs (the "or equivalent" permitted in § 68.104) must be compatible with the plugs and jacks shown. The interface dimensions between mating plugs and jacks must be maintained. Hardware used to mount, protect, and enclose standard jacks is not described. The only requirement on connecting blocks, housings, dust covers, outdoor boxes, and the like that contain standard network jacks is that they accept standard plugs with cordage. For special purpose applications, plugs may be made longer than shown or adapted for direct use on equipment or apparatus without cordage. The sliding modular plug used on the back of many modular wall telephone sets is an example of such a special purpose application. It is the responsibility of the designers and manufacturers of communication equipment who use such plugs to assure that they are compatible with the hardware used to mount standard jacks with which they plan to interface. For the purposes of this section, hard gold and contact performance equivalent to gold shall be determined in accordance with the standards detailed in Appendix H of TIA Telecommunications Systems Bulletin No. 31 Part 68 Rationale and Measurement Guidelines (TSB.31), prepared by EIA/TIA TR-41 Committee on Telephone Terminals (1992). This publication may be obtained by contacting Global Engineering Documents, 7730 Carondelet Avenue, Suite #407, St. Louis, Missouri, 63105. (Telephone number 1-800-854-7179).

(a) *Minature 6-position plug:*

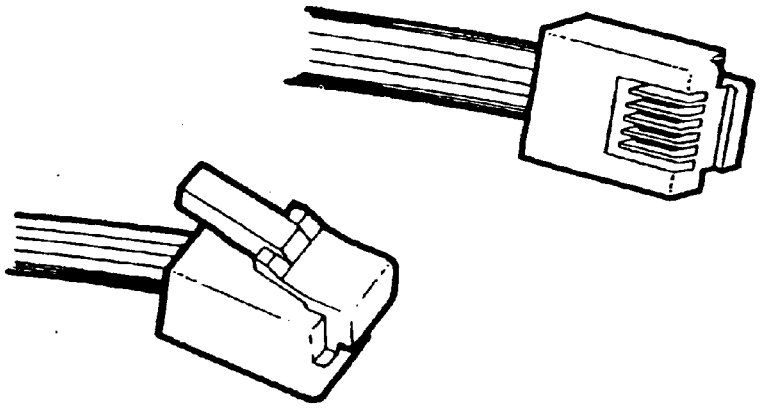
(Note: This plug is depicted equipped with 4 contacts; it may be fabricated with its full 6 contact capability.)
Figure 68.500(a)(1)(i)—View

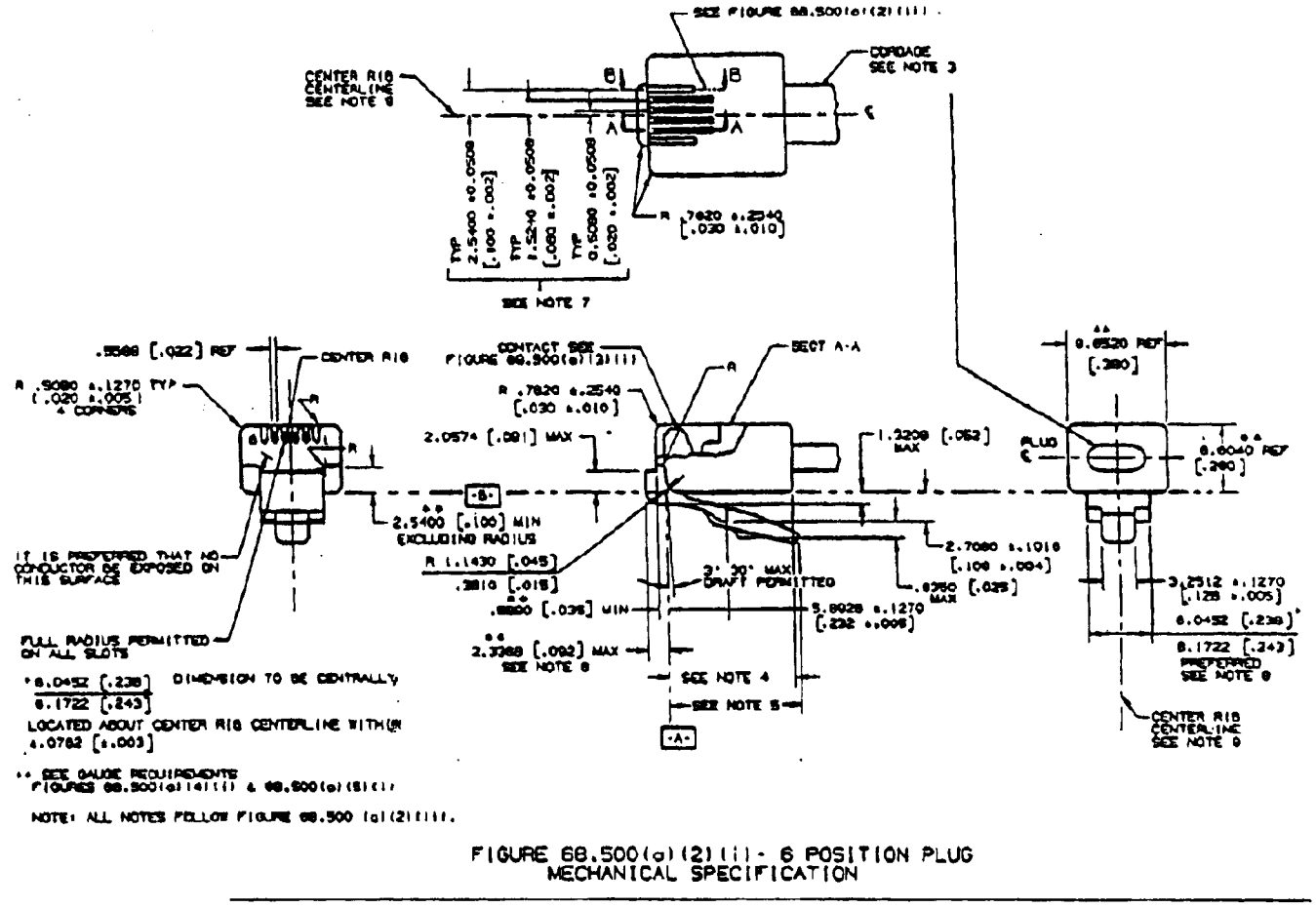
FIGURE 68.500(a)(2)(ii) - 6 POSITION PLUG MECHANICAL SPECIFICATION

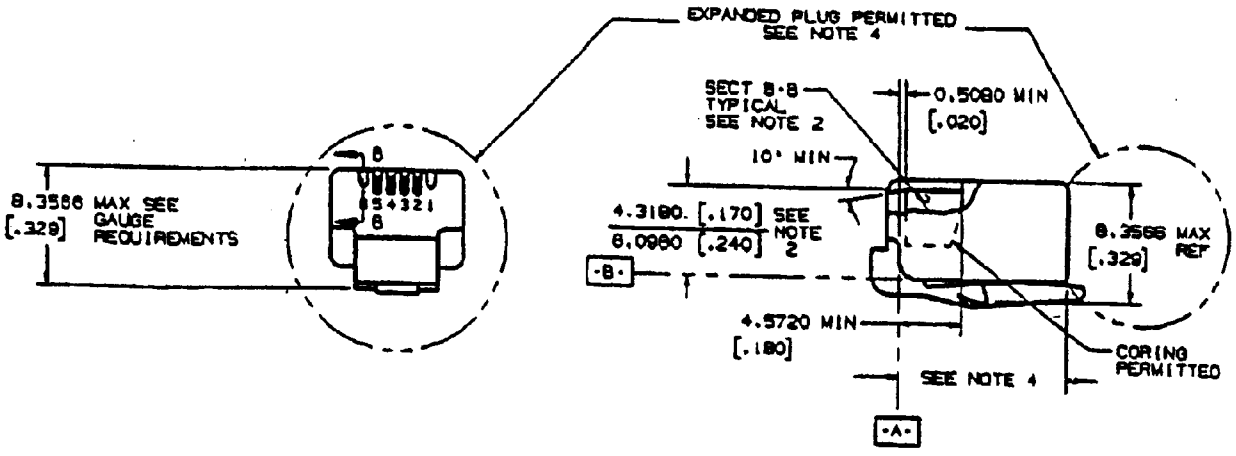
NOTE: ALL NOTES FOLLOW THIS FIGURE.
FIGURE 68.500(a)(2)(ii) - B POSITION PLUG MECHANICAL SPECIFICATION (CONTINUED)
NOTES: (Notes apply to Figures 68.500(a)(2)(i) and 68.500(a)(2)(ii))
1. All plugs must be capable of meeting the requirements of the plugs go and no-go gauges.

2. Section BB applies to any jack contact receiving slot which does not contain a plug contact.
3. The preferred major cordage cross section is 2.5400 mm (.100 inch) max. thick by 5.0800 mm (.200 inch) max. wide, with rounded corners. It should exit the plug on the plug centerline. Other cordage configurations are permitted but may inhibit the special features of some network jack enclosures.
4. The standard plug length is 11.6840 mm (.460 inch) max. Plugs may be made longer than standard or adapted for direct use on special cords, adapters with out cordage, and on apparatus or equipment subject to the limitations described in the Section 68.500 introductory paragraphs. Plugs longer than standard may inhibit the special features of some network jack enclosures.
5. A 12.0396 mm (.474 inch) minimum tab length is required. It is preferred that a maximum tab length be no longer than 13.2080 mm (.520 inch). Longer tabs may be used with the same limitations as described in Note 4.
6. To obtain maximum plug guidance when 6-position plugs are inserted in 8-position jacks, it is desirable to extend the front plug nose to the 2.3368 mm (.092 inch) maximum.
7. These dimensions apply to the location of jack contact receiving slots. It is desirable that plug contacts be centered axially in these slots, but centering is not required.
8. The 6.0452/6.1722 mm (.238/.243 inch) dimension is preferred to obtain maximum plug guidance in jacks with more than 6 conductors. A tolerance range of 5.9182/6.1722 mm (.233/.243 inch) is permitted, but may create targeting problems in 8-position jacks.
9. The center rib centerline shall be coincident with the plug width 9.6520 mm (.380 inch) ref. centerline within +/− .0762mm (+/− .003 inch).

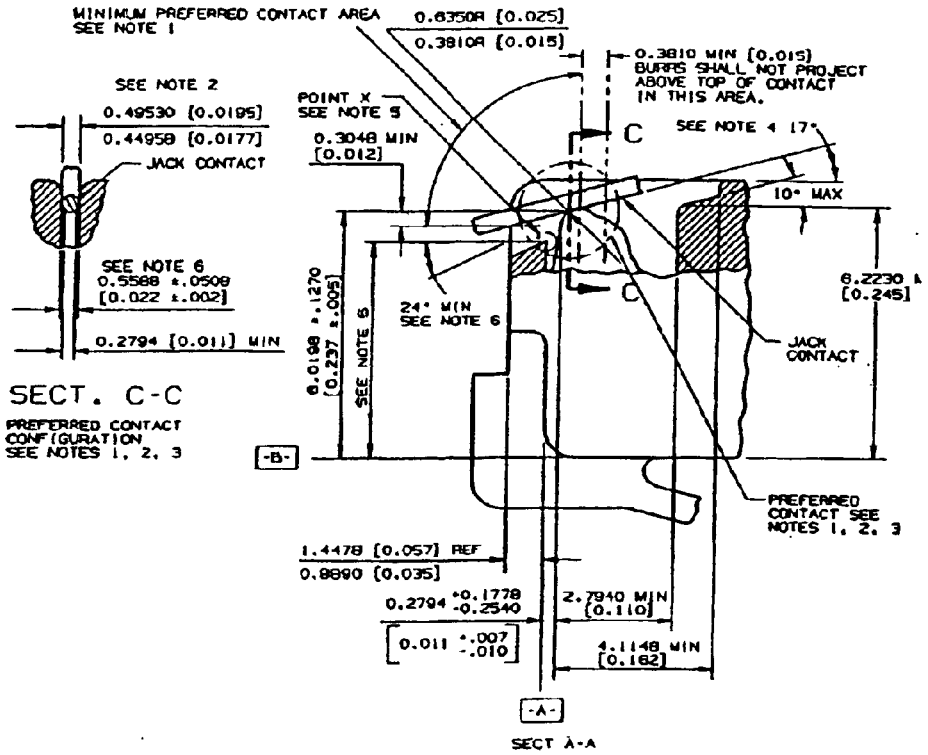

NOTE: ALL NOTES FOLLOW THIS FIGURE.

NOTE: THE 8 POSITION PLUG/JACK CONTACT SPECIFICATION IS IDENTICAL.

FIGURE 68.500(a)(3)(i)- 6 POSITION PLUG PLUG /JACK CONTACT SPECIFICATION

NOTES: (Notes apply to Figure 68.500(a)(3)(i))

1. The plug/jack contact interface should be hard gold to hard gold and should have a minimum gold thickness of .0012700 mm (0.000050 inch) on each side of the interface. The minimum contact force should be .98 N (100 grams). Any non-gold contact material must be compatible with gold and provide equivalent contact performance. A smooth, burr-free surface is required at the interface in the area shown.
2. The jack contact design is based upon .4572 mm (.018 inch) spring temper phosphor bronze round wire in the modular plug blade and jack contact interface. Other contact configurations that provide contact performance equal to or better than the preferred configurations and do not cause damage to the plug or jack are permitted. The preferred jack contact width is .44958/.49530 mm (.0177/.0195 inches). Deviations from the preferred jack contact width are permitted for round contacts as well as noncircular cross sectional shapes but they must be compatible with existing plug configurations. The requirements of Note 1 apply to all possible contact areas.
3. The configuration of the plug contact and the front plastic of the plug should prevent jack contacts from being damaged during plug insertion into jacks.

4. This is the suggested nominal contact angle between plugs and jacks with the plug latched into the jack. If this angle becomes greater than 24 degrees loss of electrical contact may occur between the plug and jack. If the nominal contact angle becomes less than 13 degrees, interference between jack contacts and the internal plastic in the plug may occur.

5. To avoid loss of electrical contact, the preferred dimension from datum B to the highest point "X" should be 5.0800 mm (.200 inch) max. A dimension greater than 5.3594 mm (.211 inch) may result in loss of electrical contact between plugs and jacks. The 5.3594 mm (.211 inch) max. shall be considered an absolute maximum.

6. The 24 degree min. angle applies only to plugs with front plastic walls higher than 4.8260 mm (.190 inches).

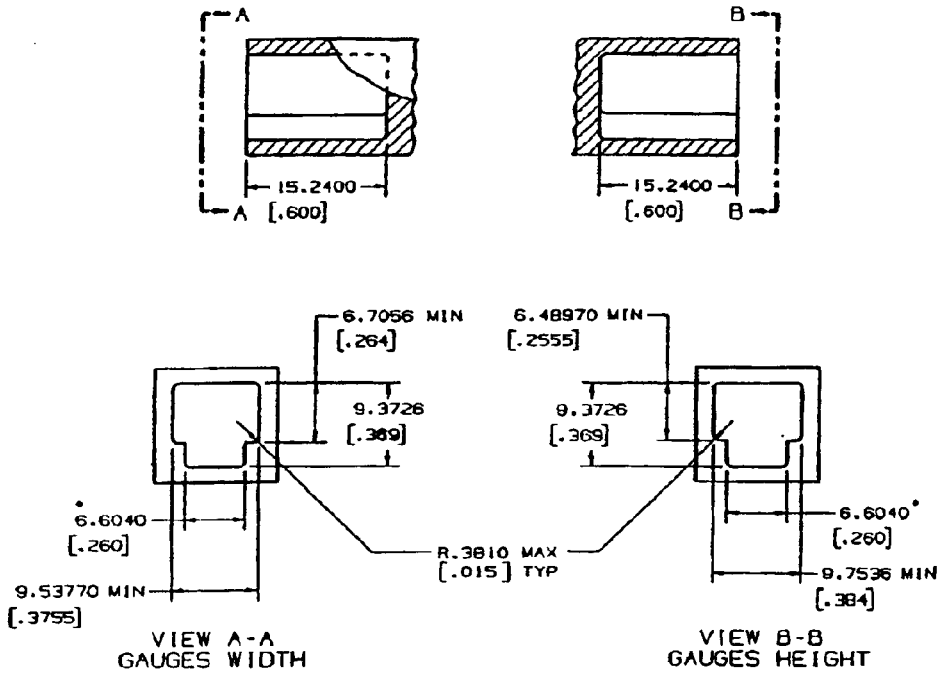
NO-GO GAUGE
NOTES:
1. THE PLUG SHALL NOT BE CAPABLE OF ENTERING THE GAUGE MORE THAN 1.7780mm [.070] BEYOND DATUM-A- (SEE FIGURE 68.500(a)(2)(i)) WITH 8.90 newtons[2.0 POUNDS] INSERTION FORCE.
2. NON-TOLERANCED DIMENSIONS GIVEN TO FOUR PLACES SHALL BE WITHIN ±0.0508mm [.002].
3. *6.6040mm [.260] DIMENSION TO BE CENTRALLY LOCATED WITH RESPECT TO 9.7536mm [.384] MINIMUM AND 9.53770mm [.3755] MINIMUM WITHIN ±0.0508mm [.002].
FIGURE 68.500(a)(4)(i)- 6 POSITION PLUG
MINIMUM PLUG SIZE

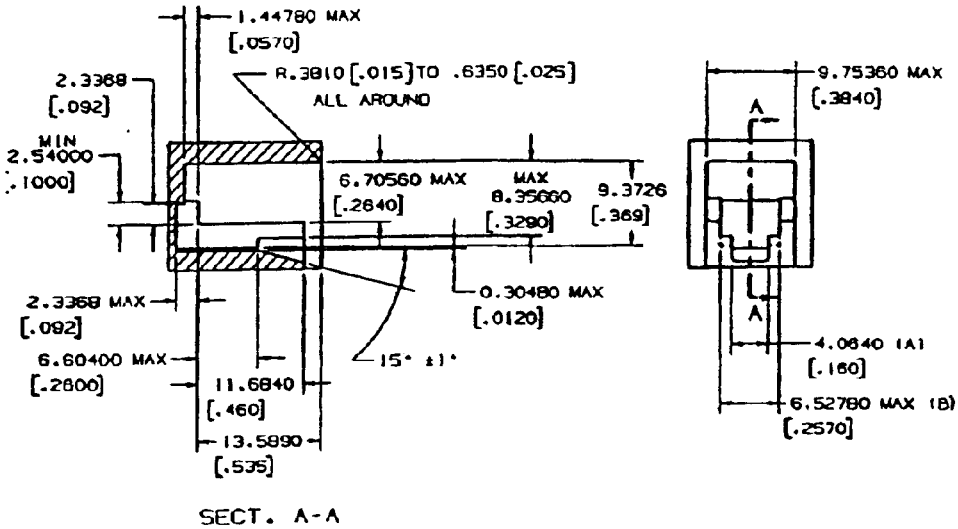

GO GAUGE

NOTES

1. THE PLUG SHALL BE CAPABLE OF INSERTION AND LATCHING INTO THE GUAGE WITH 22.24 newtons [5 POUNDS] OR LESS INSERTIONS FORCE. PLUG LATCHING BAR SHALL BE DEPRESSED SO AS NOT TO INTERFERE WITH THE PLUG ENTRY. AFTER INSERTION AND LATCHING, PLUG SHALL BE CAPABLE OF REMOVAL, WITH THE LATCH DEPRESSED, WITH A REMOVAL FORCE OF 44.48 newtons [10 POUNDS] OR LESS APPLIED AT AN ADVANTAGEOUS ANGLE.
2. DIMENSIONS GIVEN TO FOUR DECIMAL PLACES SHALL BE WITHIN ±.0508mm [±.002].
3. DIMENSIONS (A) AND (B) TO BE CENTRALLY LOCATED WITH RESPECT TO 9.75360mm [.3840] MAX. JACK OPENING WIDTH WITHIN ±0.0254mm [.001].
4. DO NOT SCALE DRAWINGS FOR EXTERNAL CONFIGURATION.

FIGURE 68.500(o)(5)(i)- 6 POSITION PLUG
MAXIMUM PLUG SIZE (b) *Miniature 6-position jack:*

(1) [Reserved]

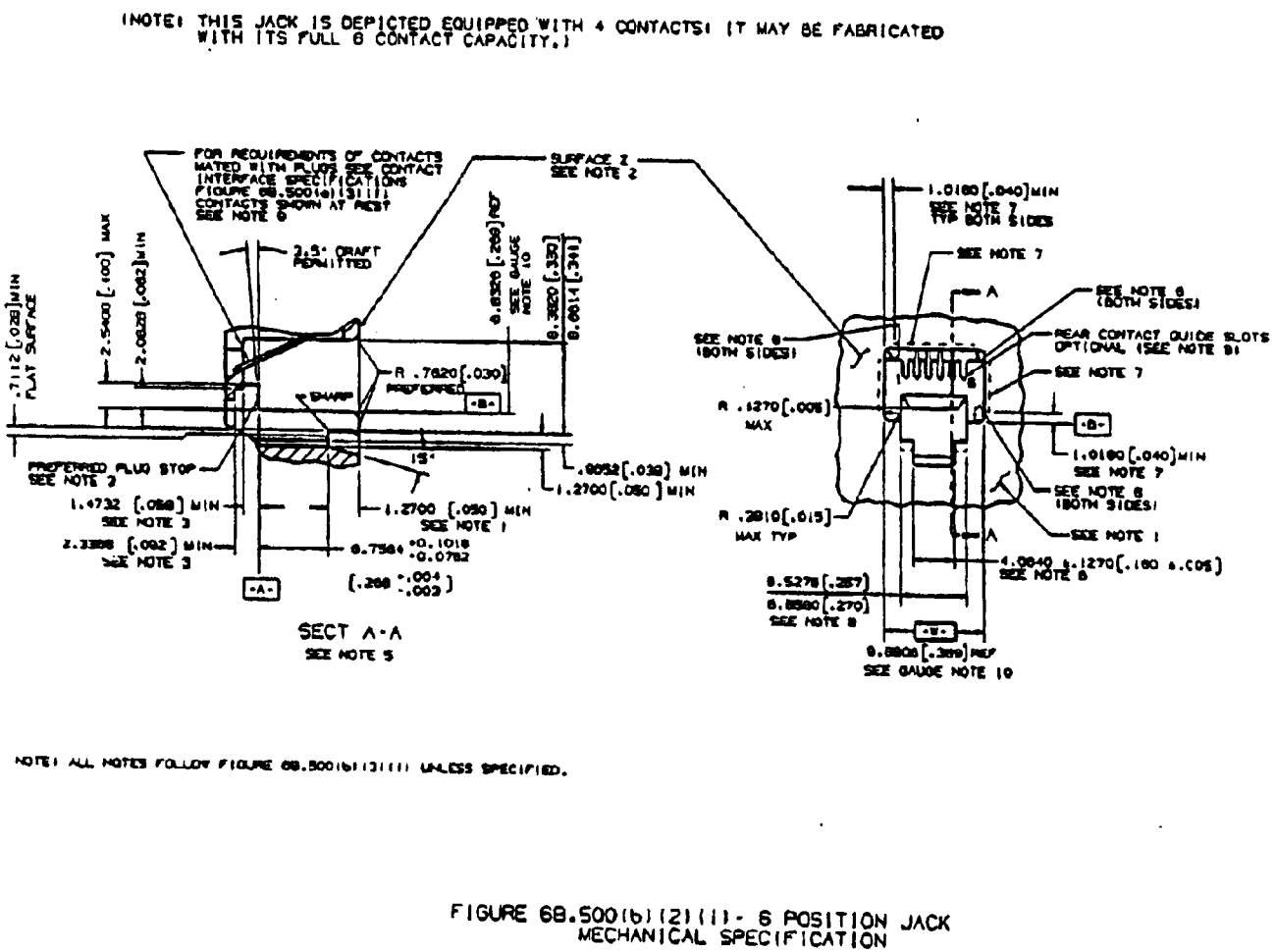
FIGURE 68.500(b)(2)(i) - 8 POSITION JACK MECHANICAL SPECIFICATION

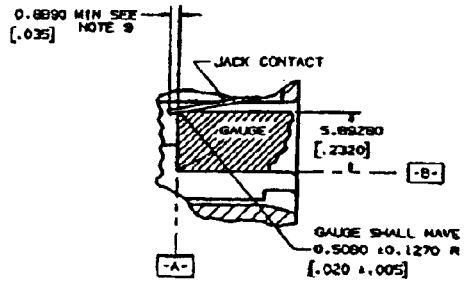

SEC A-A (SHOWN WITHOUT REAR CONTACT GUIDES)

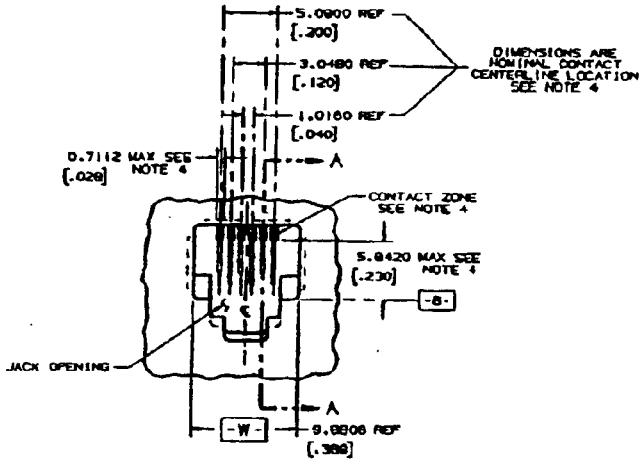

VIEW OF CONTACT ZONE (SHOWN WITHOUT REAR CONTACT GUIDES)

NOTE: ALL NOTES FOLLOW THIS FIGURE.

FIGURE 68.500(b)(3)(i)- 6 POSITION JACK MECHANICAL SPECIFICATIONS (CONTINUED)

NOTES: (Notes apply to Figures 68.500(b)(2)(i) and 68.500(b)(3)(i).)

1. Front surface projections beyond the 1.2700 mm (.050 inch) min. shall be configured so as not to prevent finger access to the plug release catch (Reference Figure 68.500(a)(2)(i), 6-Position Plug, Mechanical Specifications). A catch length greater than 1.2700 mm (.050 inch) is beneficial in providing greater breakout strength.

2. Surface Z need not be planar or coincident with the surface under the plug release catch. Surface Z projections must not prevent insertion, latching, and unlatching of the standard 6-position plug described in §68.500(a).
3. The preferred plug stop surface is indicated. If some other internal feature is used as a plug stop, it must be located so that the axial movement of a latched plug is no greater than 1.1430 mm (0.045 inch).
4. To prevent mistargeting between the plug and jack contacts, the jack contacts should be completely contained in their individual contact zones, .7112 mm (.028 inch) max. wide, where they extend into the jack openings. There is no location requirement for jack contacts below these zones 5.8420 mm (.230 inch) max., but adequate contact separation must be maintained to prevent electrical breakdown. These shaded contact zones should be centrally located, (included all locating tolerances), about the jack opening width 9.8806 mm (.389 inch) Ref. (Datum -W-). Contacts located outside of these zones may result in mistargeting between the jack and plug contacts.
5. All inside and outside corners in the plug cavity to be .3810 mm (.015 inch) radius max. unless specified.
6. These surfaces shall have 0°15′ maximum draft.
7. Relief inside the dotted areas on 3 sides of the jack opening is permitted. The 6.8326 mm (.269 inch) Ref and 9.8806 mm (.389 inch) Ref Gauge Requirements must be maintained in each corner, (ref. 1.0160 mm (0.040 inch) min), to assure proper plug/jack interface guidance. A .8128 mm ±.1270 mm (.032 inch ±.005 inch) relief on the top side, (opposite plug catch), is required on jacks in connecting blocks which mount and connect portable wall telephones so as to assure interface with the special purpose sliding modular plug used on many wall telephone sets.
8. 4.0640 mm (.160 inch) and 6.5278/6.8580 mm (.257/.270 inch) dimensions to be centrally located to jack opening width -W- within ±.1778 mm (0.007 inch).
9. Minimum acceptable jack contact length. When contact guide slots are used, the contacts must always be contained inside the guide slots and the contacts must move freely in the slots so as not to restrain plug insertion or damage jack contacts.
10. Gauge Requirements:

GO: The jack shall be capable of accepting a 9.7536 x 6.7056 mm (0.3840 x 0.2640 inch) gauge and the gauge shall be capable of being removed with a maximum force of 8.9 newtons (2 pounds).

NO GO: The jack shall not accept either a 10.00760 x 6.45160 mm (0.3940 x 0.254 inch) horizontal width of opening gauge or a 6.95960 x 9.5504 mm (.2740 x .376 inch) vertical height of opening gauge. However, if either gauge is accepted the force necessary to remove the gauge shall be minimum .83 newtons (3.0 ounces).

Removal forces do not include forces contributed by contact springs nor shall external forces be applied to the jack that will affect these removal forces.

Gauges shall have a .7620 mm (.030 inch) radius on the nose and a .3810 mm (0.015 inch) radius on all edges with clearance provided for contacts.

(c) *Miniature 8-position plug, unkeyed:*

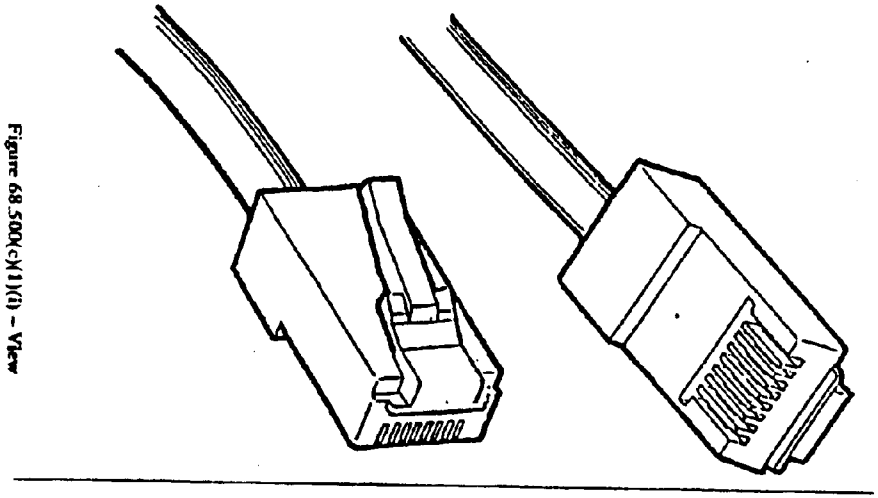
Figure 68.500(c)(1)(i) – View

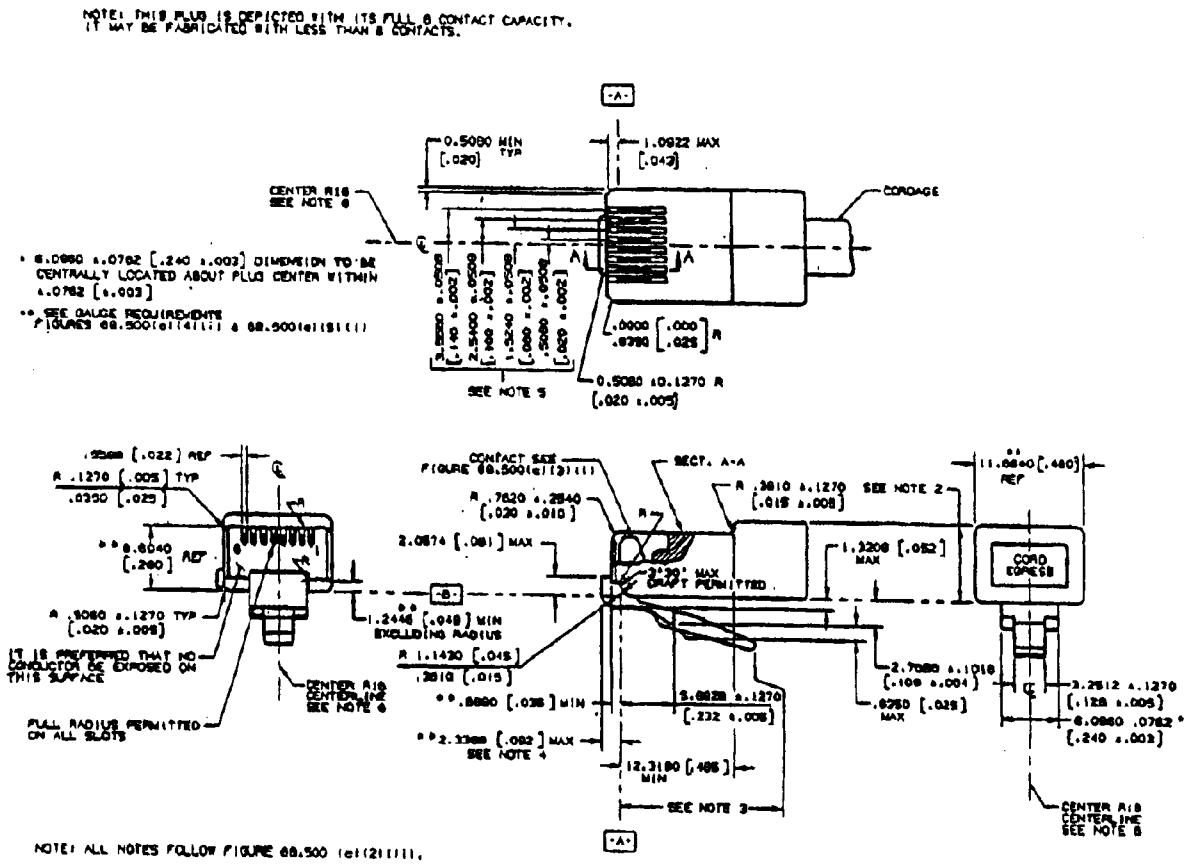
FIGURE 68.500(c)(2)(i) - 8 POSITION UNKEYED PLUG, MECHANICAL SPECIFICATION

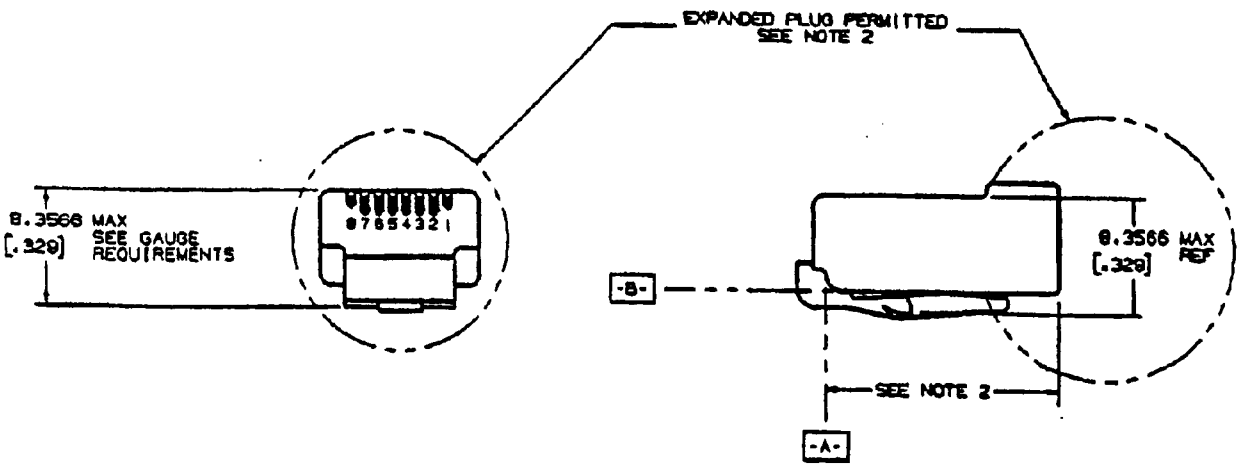
NOTE: ALL NOTES FOLLOW THIS FIGURE.
FIGURE 68.500(c)(2)(ii) : 8 POSITION UNKEYED PLUG, MECHANICAL SPECIFICATION (CONTINUED)
NOTES: (Notes apply to Figures 68.500(c)(2)(i) and 68.500(c)(2)(ii))
1. All plugs must be capable of meeting the requirements of the plug go and no-go gauges.

2. The standard plug height in the area shown is 8.0010 mm (.315 inch) maximum. The standard plug length is 23.1140 mm (.910 inch) maximum. Plugs may be made longer than standard or adapted for direct use on special cords, adapters without cordage, apparatus or equipment subject to the limitations described in the introductory paragraphs of 68.500. Plugs longer and/or higher than standard may inhibit the special features of some network jack enclosures.
3. A 14.6050 mm (.575 inch) minimum tab length is required. It is preferred that a maximum tab length be no longer than 15.8750 mm (.625 inch). Longer tabs may be used with the same limitations described in Note 2.
4. To obtain maximum plug guidance in jacks, it is desirable to extend the front plug nose to the 2.3368 mm (.092 inch) maximum.
5. These dimensions apply to the location of jack contact receiving slots. It is desirable that plug contacts be centered axially in these slots, but centering is not required.
6. The center rib centerline shall be coincident with the plug width 11.6840 mm ref. (.460 inch ref.) centerline within ±.0762 mm (.003 inch).

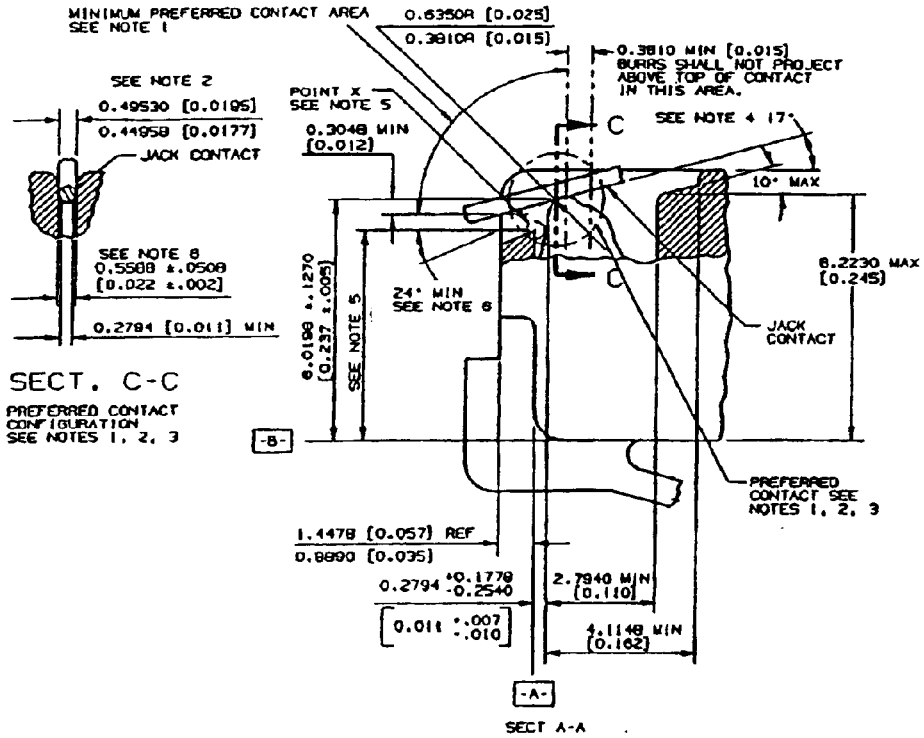

NOTE: ALL NOTES FOLLOW THIS FIGURE.

NOTE: THE 6 POSITION PLUG/JACK CONTACT SPECIFICATION IS IDENTICAL.

FIGURE 68.500(c)(3)(i)- 8 POSITION UNKEYED PLUG PLUG /JACK CONTACT SPECIFICATION

NOTES: (Notes apply to Figure 68.500(c)(3)(i))

1. The plug/jack contact interface should be hard gold to hard gold and should have a minimum gold thickness of .0012700 mm (.000050 inch) on each side of the interface. The minimum contact force should be .98 N (100 grams). Any non-gold contact material must be compatible with gold and provide equivalent contact performance. A smooth, burr-free surface is required at the interface in the area shown.
2. The jack contact design is based upon .4572 mm (.018 inch) spring temper phosphor bronze round wire in the modular plug blade and jack contact interface. Other contact configurations that provide contact performance equal to or better than the preferred configurations and do not cause damage to the plug or jack are permitted. The preferred jack contact width is .44958/.49530 mm (.0177/.0195 inches). Deviations from the preferred jack contact width are permitted for round contacts as well as noncircular cross sectional shapes but they must be compatible with existing plug configurations. The requirements of Note 1 apply to all possible contract areas.
3. The configuration of the plug contact and the front plastic of the plug should prevent jack contacts from being damaged during plug insertion into jacks.
4. This is the suggested nominal contact angle between plugs and jacks with the plug latched into the jack. If this angle becomes greater than 24 degrees loss of electrical contact may occur between the plug and jack. If the nominal contact angle becomes less than 13 degrees, interference between jack contacts and the internal plastic in the plug may occur.
5. To avoid loss of electrical contact, the preferred dimension from datum B to the highest point "X" should be 5.0800 mm (.200 inch) max. A dimension greater than 5.3594 mm (.211 inch) may result in loss of electrical contact between plugs and jacks. The 5.3594 mm (.211 inch) max. shall be considered an absolute maximum.
6. The 24 degree min. angle applies only to plugs with front plastic walls higher than 4.8260 mm (.190 inches).

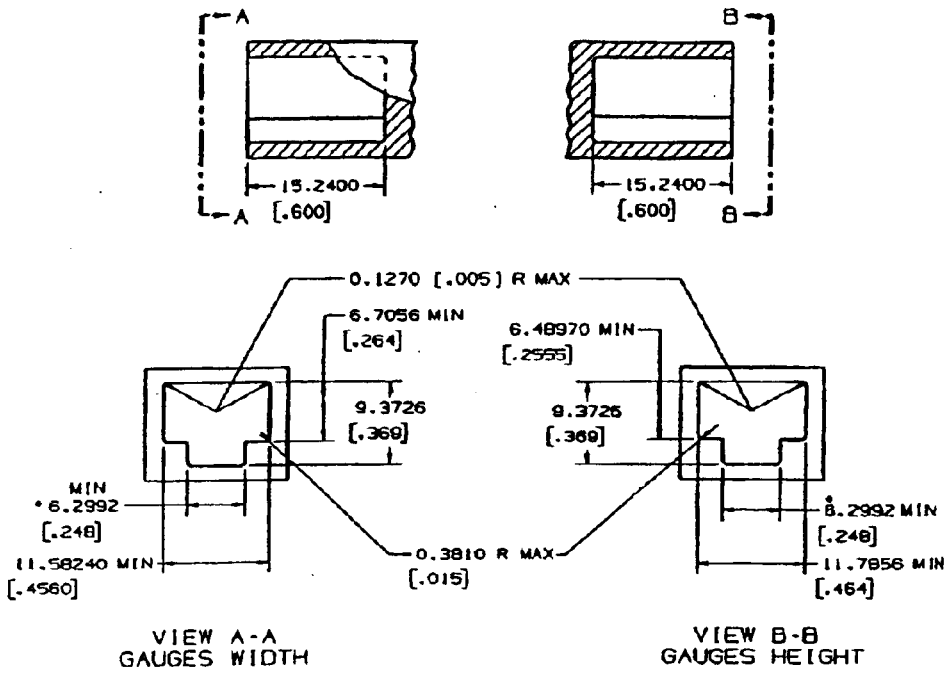
NO-GO GAUGE
NOTES:
1. THE PLUG SHALL NOT BE CAPABLE OF ENTERING THE GAUGE MORE THAN 1.7780mm [.070] BEYOND DATUM-A-(SEE FIGURE 68.500(c)(2)(i)) WITH 8.90 newton [2.0 POUNDS] INSERTION FORCE.
2. NON-TOLERANCED DIMENSIONS GIVEN TO FOUR PLACES SHALL BE WITHIN ±0.0508mm [.002].
3. • 6.2992mm [.248] DIMENSION TO BE CENTRALLY LOCATED WITH RESPECT TO 11.7856mm [.484] MINIMUM AND 11.58240mm [.4560] MIMIMUM WITHIN ±0.0508mm [.002].
FIGURE 68.500(c)(4)(i)-B POSITION UNKEYED PLUG, MINIMUM PLUG SIZE

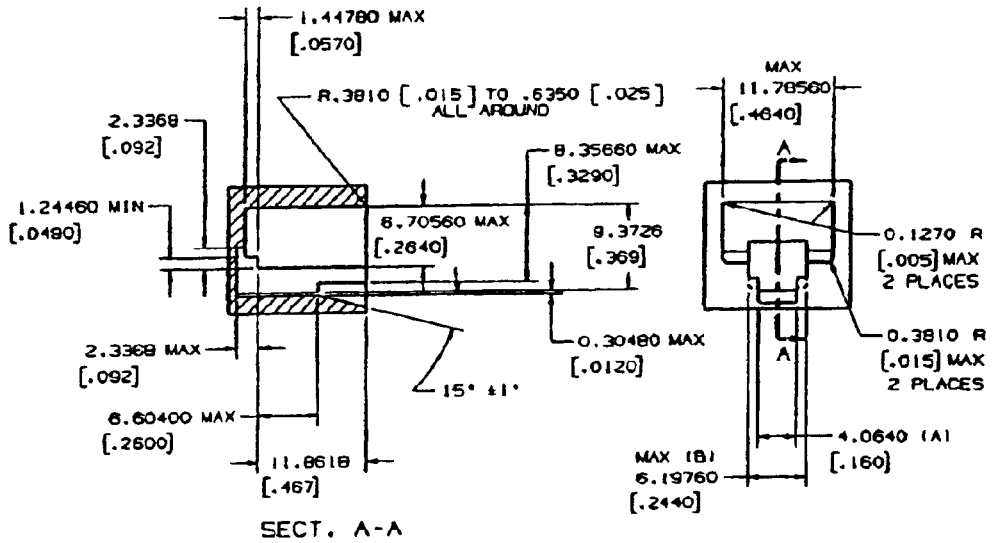

GO GAUGE

NOTES:

1. THE PLUG SHALL BE CAPABLE OF INSERTION AND LATCHING INTO THE GAUGE WITH 22.24 newtons [5 POUNDS] OR OR LESS INSERTION FORCE. PLUG LATCHING BAR SHALL BE DEPRESSED SO AS NOT TO INTERFERE WITH THE PLUG ENTRY. AFTER INSERTION AND LATCHING, PLUG SHALL BE CAPABLE OF REMOVAL, WITH THE LATCH DEPRESSED, WITH REMOVAL FORCE OF 44.48 newtons [10 POUNDS] OR LESS APPLIED AT AN ADVANTAGEOUS ANGLE.
2. DIMENSIONS GIVEN TO FOUR DECIMAL PLACES SHALL BE WITHIN ±.0508mm [.002].
3. DIMENSIONS (A) AND (B) TO BE CENTRALLY LOCATED WITH RESPECT TO 11.78560mm [.4640] MAX. JACK OPENING WIDTH WITHIN ±0.0254mm [.001].
4. DO NOT SCALE DRAWINGS FOR EXTERNAL CONFIGURATION.

FIGURE 68.500(c)(5)(ii)-8 POSITION UNKEYED PLUG, MAXIMUM PLUG SIZE (d) *Miniature 8-position series jack:*

(d) *Miniature 8-position series jack:*
APPENDIX A-17
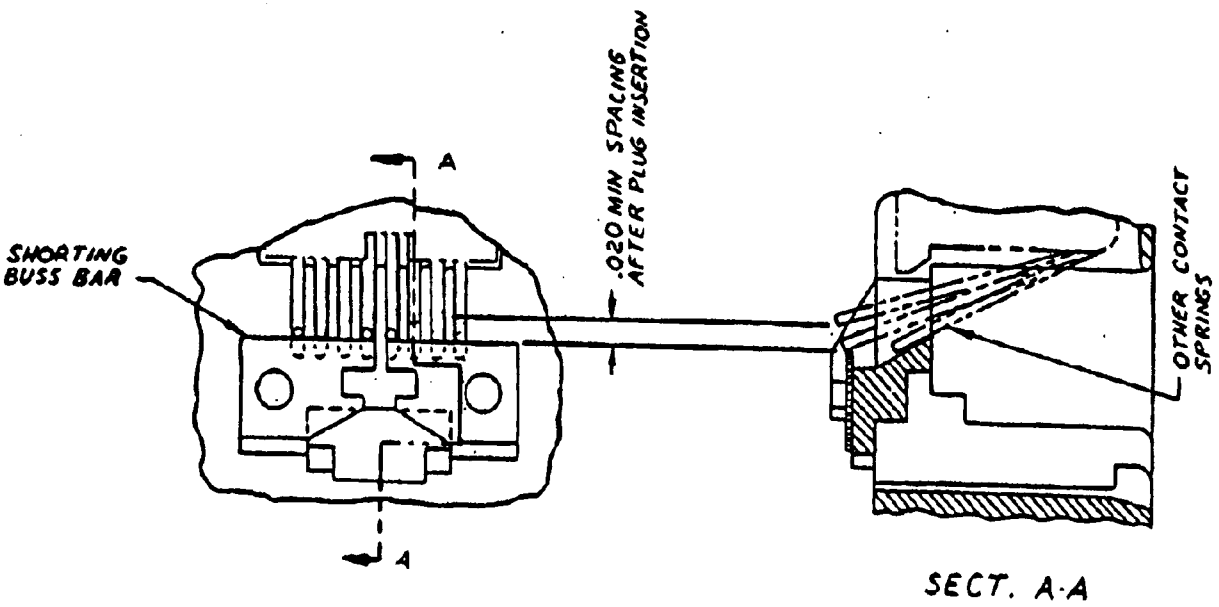
Figure 68.500(d)(3)--8 Position Series Jack, Contact Specification

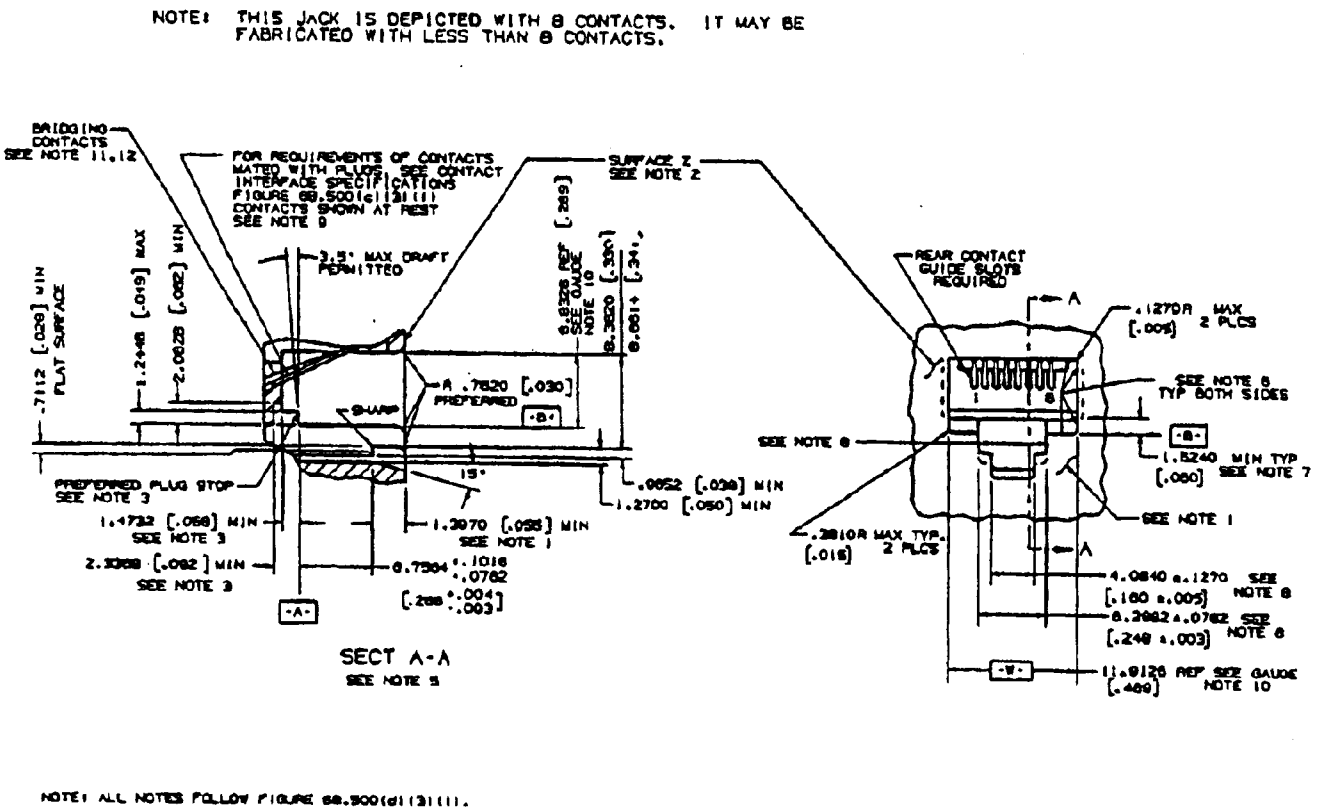
FIGURE 68.500(d)(2)(i)-8 POSITION SERIES JACK, MECHANICAL SPECIFICATION

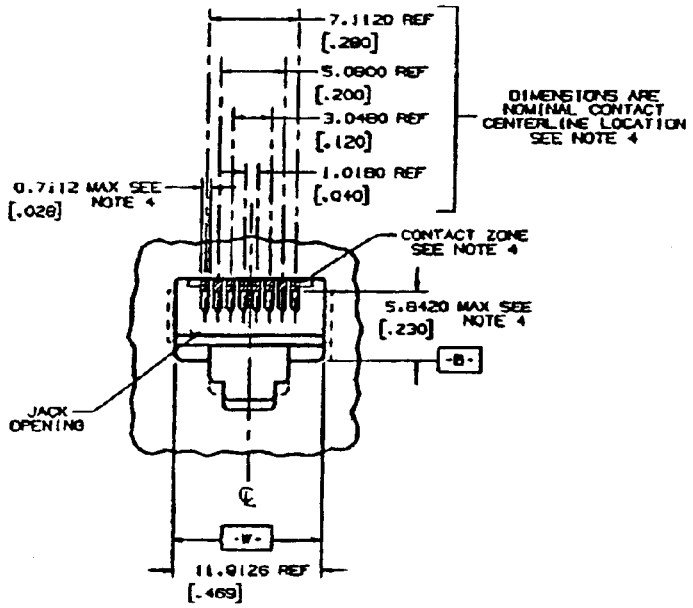

VIEW OF CONTACT ZONE

NOTE: ALL NOTES FOLLOW THIS FIGURE.

FIGURE 68.500(d)(3)(i)-8 POSITION SERIES JACK, MECHANICAL SPECIFICATION (CONTINUED)

NOTES: (Notes apply to Figures 68.500(d)(2)(i) and 68.500(d)(3)(i))

1. Front surface projections beyond the 1.3970 mm (.055 inch) minimum shall be configured so as not to prevent finger access to the plug release catch (Reference Figure 68.500(a)(2)(i) and Figure 68.500(c)(2)(i) 6 and 8-Position Plug, Mechanical Specifications). A catch length greater than 1.3970 mm (.055 inch) is beneficial in providing for greater breakout strength and improved guidance when interfacing with a 6-position plug.
2. Surface Z need not be planar or coincident with the surface under the plug release catch. Surface Z projections must not prevent insertion, latching, and unlatching of the standard 8-position plug on Figure 68.500(c)(2)(i).
3. The preferred plug stop surface is indicated. If some other internal feature is used as a plug stop, it must be located so that the axial movement of a latched plug is no greater than 1.1430 mm (.045 inch).

4. To prevent mistargeting between the plug and jack contacts, the jack contacts should be completely contained in their individual contact zones, (.7112 mm (.028 inch) max. wide), where they extend into the jack openings. There is no location requirement for jack contacts below these zones (5.8420 mm (.230 inch) max.), but adequate contact separation must be maintained to prevent electrical breakdown. These shaded contact zones should be centrally located, (include all locating tolerances), about the jack opening width 11.9126 mm (.469 inch) Ref, (Datum -W-). Contacts located outside of these zones may result in mistargeting between the jack and plug contacts.
5. All inside and outside corners in the plug cavity to be .3810 mm (.015 inch) radius max. unless specified.
6. These surfaces shall have 0°15′ maximum draft.
7. Relief inside the dotted areas on both sides of the jack opening is permitted. The 6.8326 mm (.269 inch) Ref and 11.9126 mm (.469 inch) Ref Gauge Requirements must be maintained in each of the corners indicated, (Ref. 1.5240 mm (.060 inch) min), to assure proper plug/jack interface guidance.
8. 4.0640 mm (.160 inch) and 6.2992 mm (0.248 inch) dimensions to be centrally located to jack opening width -W- within ±-. 1270 mm (.005 inch).
9. The contact lengths shall be such that the contacts will always be contained inside the guide slots, and the contacts must move freely in the slots so as not to restrain plug insertion or damage jack contacts.
10. Gauge Requirements:

GO: The jack shall be capable of accepting an 11.7856 x 6.7056 mm (.4640 x .2640 inch) gauge and the gauge shall be capable of being removed with a maximum force of 8.9 newtons (2.0 pounds).

NO GO: The jack shall not accept either a 12.0396 x 6.4516 mm (.4740 x .254 inch) horizontal width of opening gauge or a 6.9596 x 11.5824 mm (.2740 x .456 inch vertical height of opening gauge. However, if the gauge is accepted, the force necessary to remove the gauge shall be a minimum of .83 newtons (3.0 ounces).

Removal forces do not include forces contributed by contact springs nor shall external forces be applied to the jack that will affect these removal forces.

Gauges shall have a .7620 mm (.030 inch) radius on the nose and a .3810 mm (.015 inch) radius on all edges with clearance provided for contacts.

11. With no plug inserted, conductors 1 and 4 are bridged as well as conductors 5 and 8. With a miniature 8-position plug inserted into the jack, the bridge connectors are broken and a series connection can be made in both sides of the line. With a 6-position plug inserted, the bridged connections remain unbroken.
12. The jack contact/bridging interface should be hard gold to hard gold and should have a minimum gold thickness of .0012700 mm (.000050 inch) on each side of the interface. The minimum contact bridging force should be .294 N (30 grams). Any non-gold contact material must be compatible with gold and provide equivalent contact performance.

(e) *50-position miniature ribbon plug:*

(1) Contact finish in the region of contact shall be gold, .0007620 mm (.000030 inch) minimum thickness, electrodeposited hard gold preferred.[1]

(2) "Datum B" is the center line of contact cavities.

(3) The center line of each contact shall be located within .2286 mm (.009 inch) of true position with respect to "Datum B".[1]

(4) Contact width at region of contact shall be 1.1430±.0508 mm (.045±0.002 inch).[1]

(5) Center line of shell dimension indicated shall be within .1270 mm (.005 inch) of "Datum B".[1]

(6) Center line of barrier dimension indicated shall be within .1270 mm (.005 inch) of "Datum B".[1]

(7) "Surface X" shall have a .0001016 mm (4 microinch) finish or better; finishing shall be done in the direction of the arrow.[2]

(8) A force of not more than 178 newtons (40 pounds) shall be sufficient to fully insert the plug onto the sizing gauge shown on Figure 68.500(e)(1). The plug is fully inserted when "Surface A" of the plug[1] touches "Surface A" of the sizing gauge.

(9) After one insertion of the plug on the sizing gauge, Figure 68.500(e)(2), a force of not more than 44.5 newtons (10 pounds) shall be sufficient to fully insert the plug on the continuity gauge shown in Figure 68.500(e)(3). The plug is fully inserted on the continuity gauge when "Surface A" of the plug[1] touches "Surface A" of the continuity gauge.

(10) When the plug is fully inserted on the continuity gauge, Figure 68.500(e)(3), after having been inserted once on the sizing gauge, Figure 68.500(e)(2), all contacts of the plug shall electrically contact the continuity gauge as determined by an electrical continuity test which applies an open circuit voltage of not more than 10 volts, and will not indicate continuity if the resistance of the circuit being checked is more than 200 ohms.

[1] Figure 68.500(e)(1).

[2] Figures 68.500 (e)(2) and (e)(3).

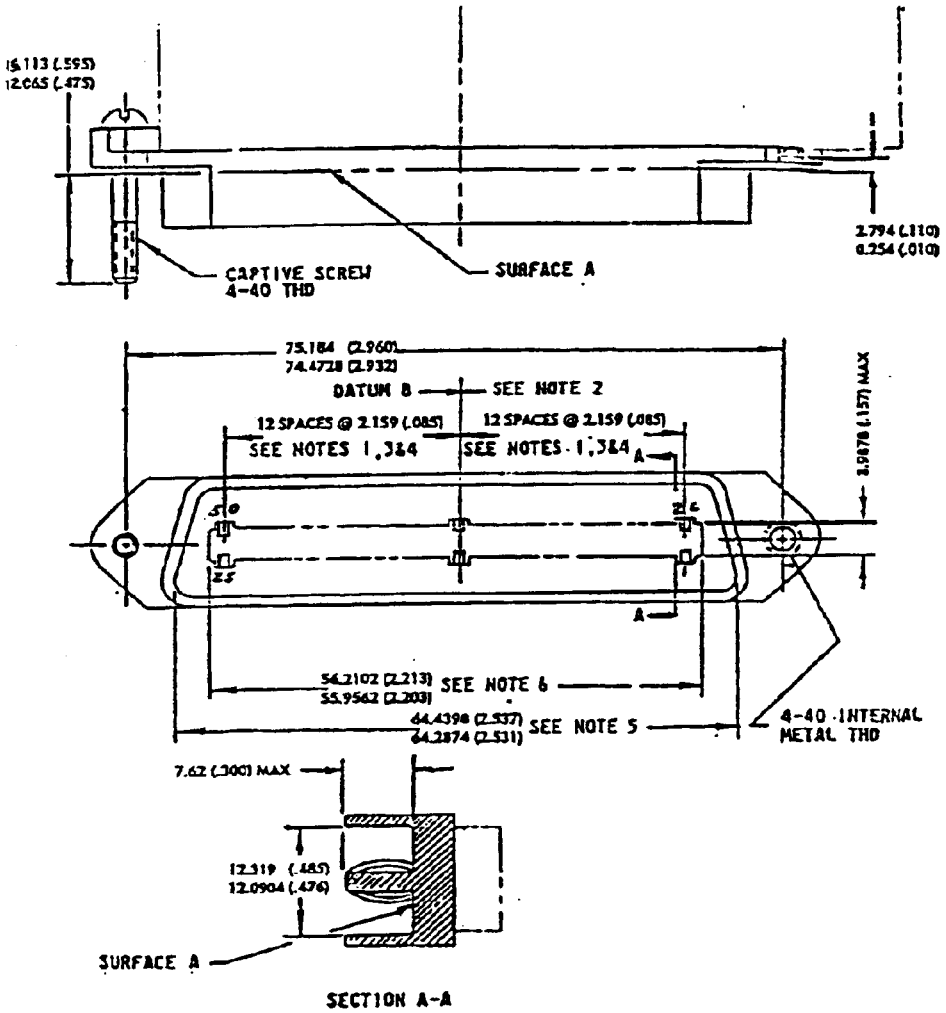
Figure 68.500(a)(13)—50 Position Miniature Ribbon Plug

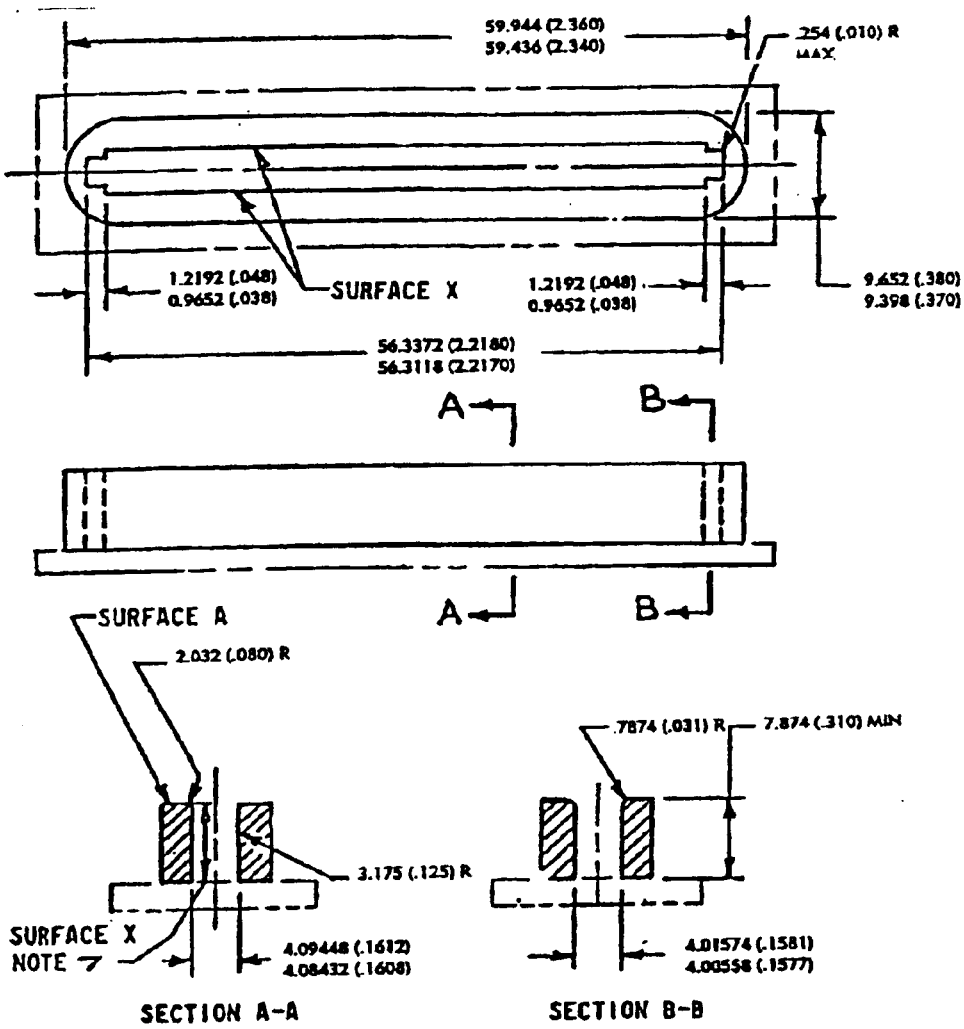
Figure 68.500(a)(2)--50 Position Miniature Ribbon Plug Sizing Guage

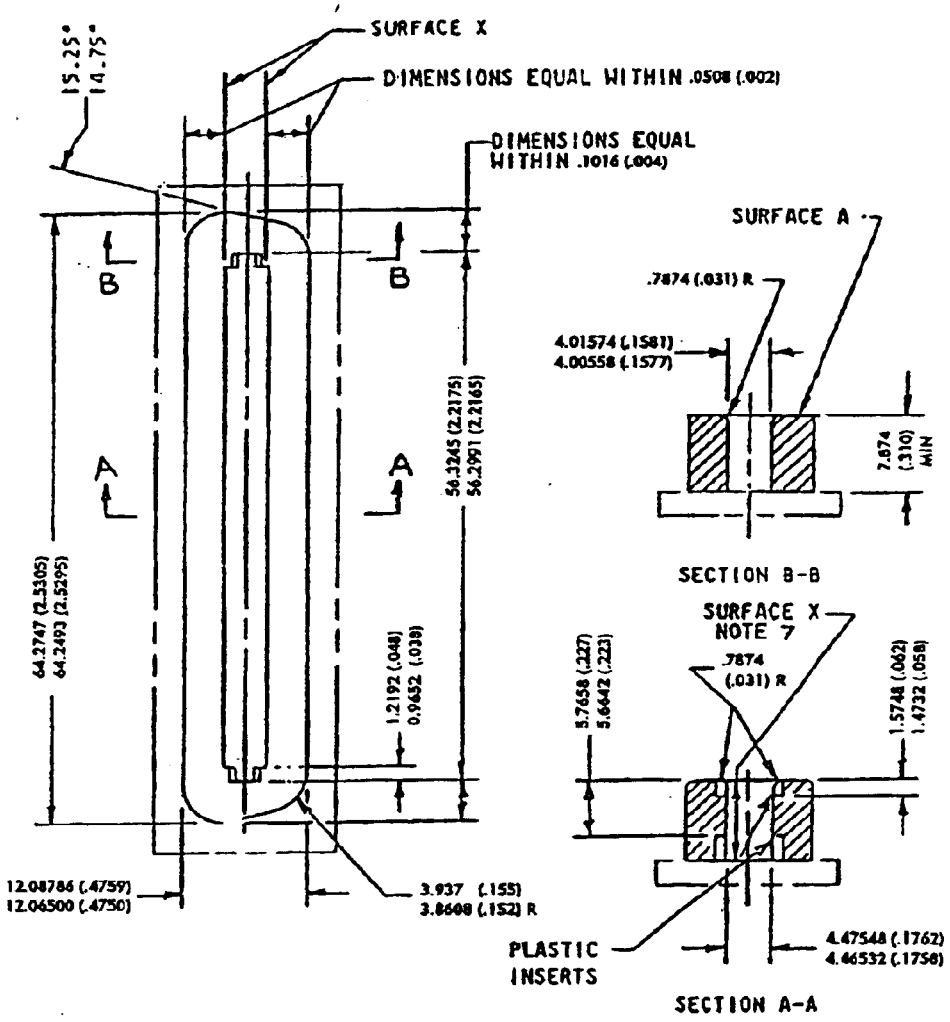
Figure 68.500(e)(3)--50 Position Miniature Ribbon Plug Continuity Guage

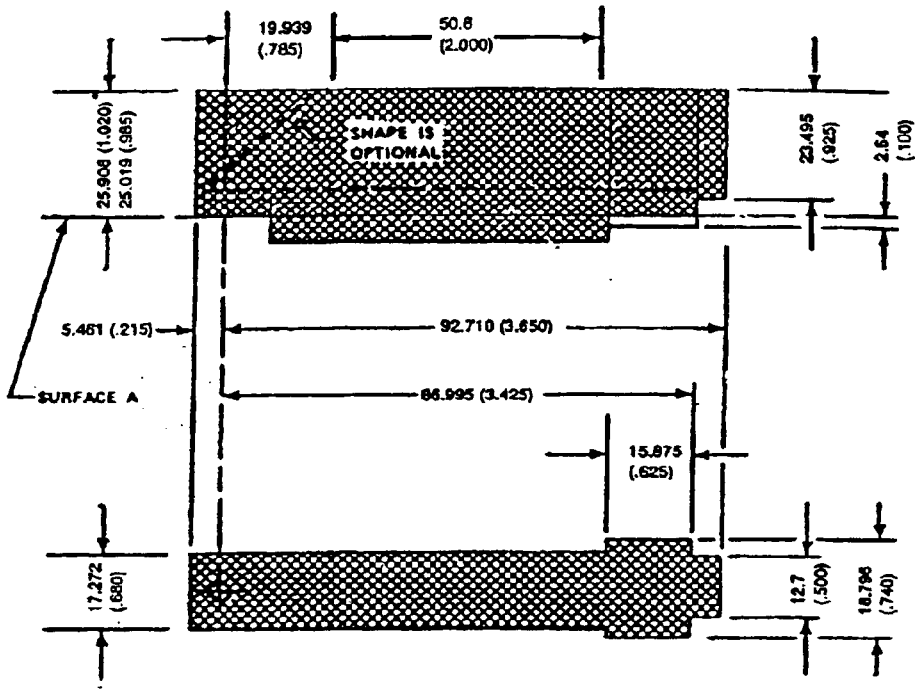

Figure 68.500(e)(4)

50-POSITION MINIATURE RIBBON PLUG - HOOD ENVELOPE (f) *50-position miniature ribbon jack:*

(1) Contact finish in the region of contact shall be gold, .0007620 mm (.000030 inch) minimum thickness, electrodeposited hard gold preferred.[1]

(2) "Datum B" is the center line of contact cavities.

(3) The center line of each contact shall be located within .2286 mm (.009 inch) of true position with respect to "Datum B".[1]

(4) Contact width at region of contact shall be 1.1430±.0508 mm (.045±0.002 inch).[1]

(5) Center line of shell dimension indicated shall be within .1270 mm (.005 inch) of "Datum B".[1]

(6) Center line of cavity dimension indicated shall be within .1270 mm (.005 inch) of "Datum B".[1]

(7) "Surface X" shall have a .0001016 mm (4 microinch) finish or better; finishing shall be done in the direction of the arrow.[2]

[1] Figure 68.500(f)(1).

[2] Figures 68.500 (f)(2) and (f)(3).

(8) A force of not more than 134 newtons (30 pounds) shall be sufficient to fully insert the jack onto the sizing gauge shown on Figure 68.500(f)(2).

The jack is fully inserted when "Surface A" of the jack[1] touches "Surface A" of the sizing gauge.

(9) After one insertion of the jack on the sizing gauge, Figure 68.500(f)(2), a force of not more than 44.5 newtons (10 pounds) shall be sufficient to fully insert the jack on the continuity gauge shown in Figure 68.500(f)(3). The jack is fully inserted on the continuity gauge when "Surface A" of the jack[1] touches "Surface A" of the continuity gauge.

(10) When the jack is fully inserted on the continuity gauge, Figure 68.500(f)(3), after having been inserted once on the sizing gauge, all contacts of the jack shall electrically contact the continuity gauge as determined by an electrical continuity test which applies an open circuit voltage of not more than 10 volts, and will not indicate continuity if the resistance of the circuit being checked is more than 200 ohms.

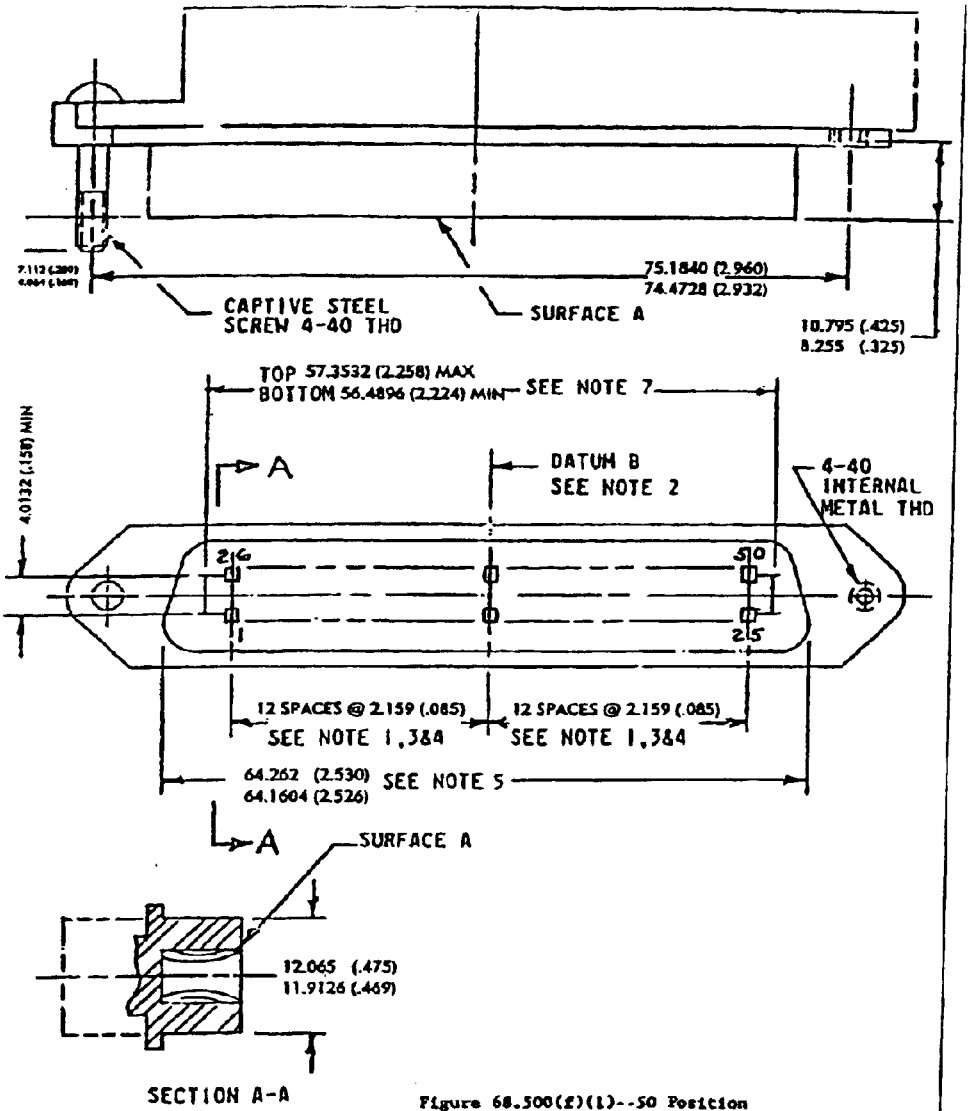
Figure 68.500(f)(1)--50 Position Miniature Ribbon Jack

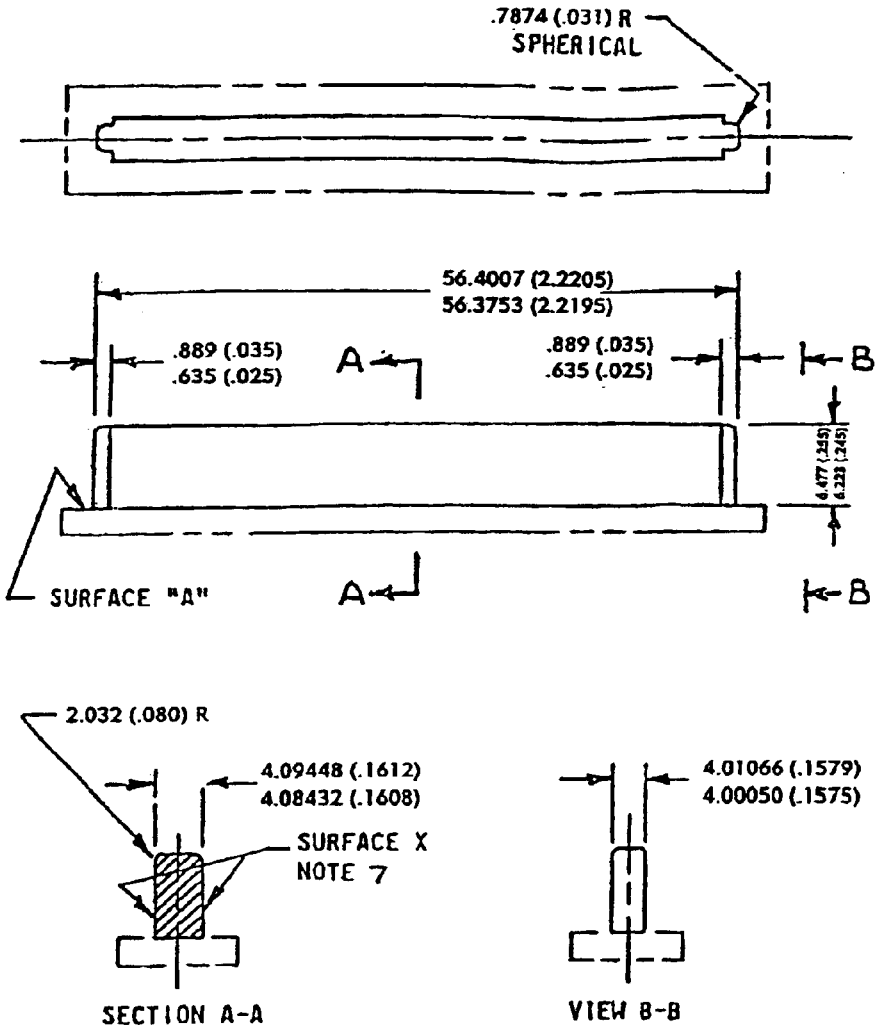
Figure 68.500(f)(2)--50 Position
Miniature Ribbon Jack
Sizing Guage

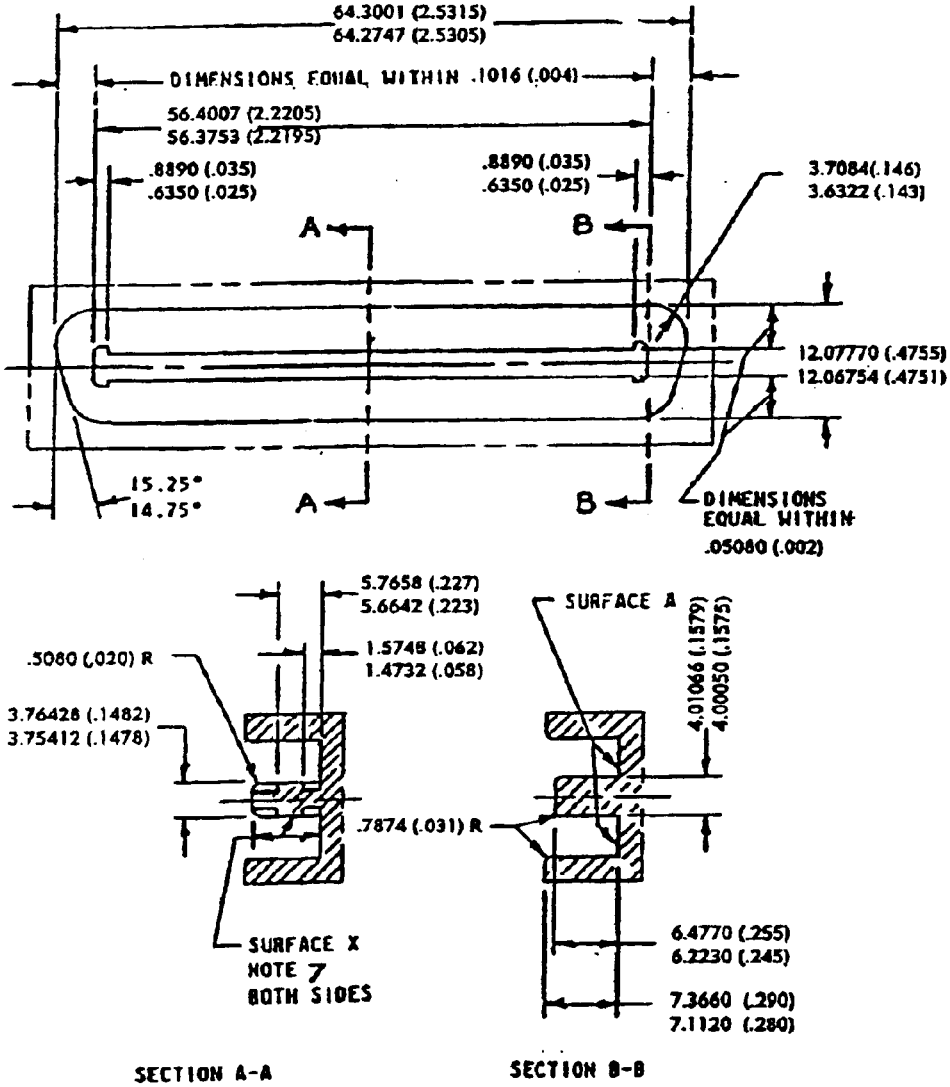
Figure 68.500(g)(3)--30 Position Miniature Ribbon Jack Continuity Gauge
(g) *3-Position weatherproof plug:*
Contact blade material shall be brass, with minimum .00762 mm (.0003 inch) thick nickel plating.
NOTE: All linear dimensions are in millimeters (inches).

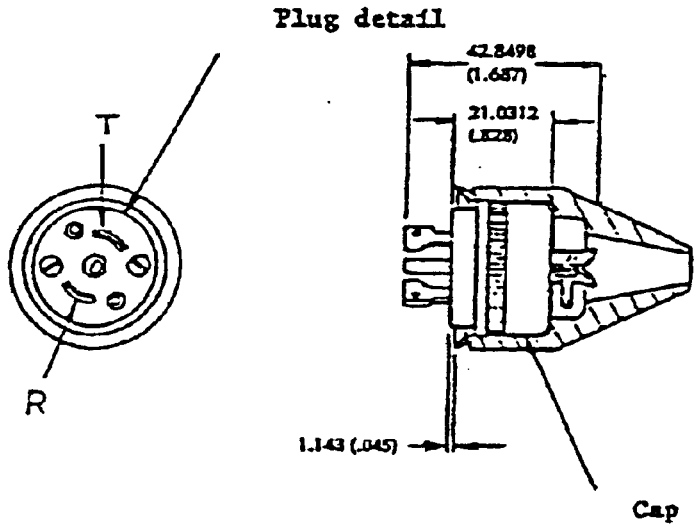
Figure 68.500(g)(1)--3 Position Plug
Plug Assembly

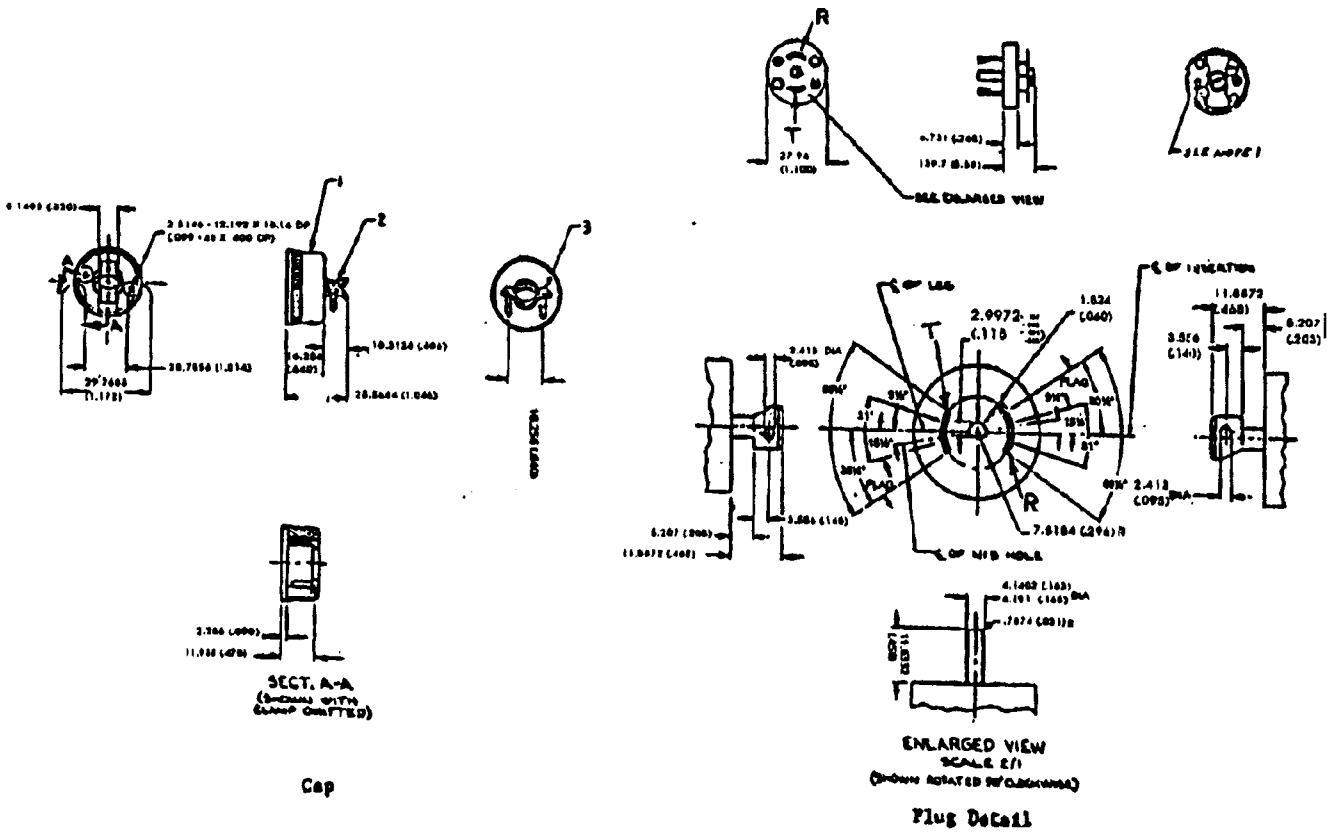
Figure 68.500(g)(2)--3 Position Plug Detail
(h) *3-Position weatherproof jack:*
Contact blade material shall be brass, with minimum .00762 mm (.0003 inch) thick nickel plating.
NOTE: All linear dimensions are in millimeters (inches).

(Note: All linear dimensions are in inches.)
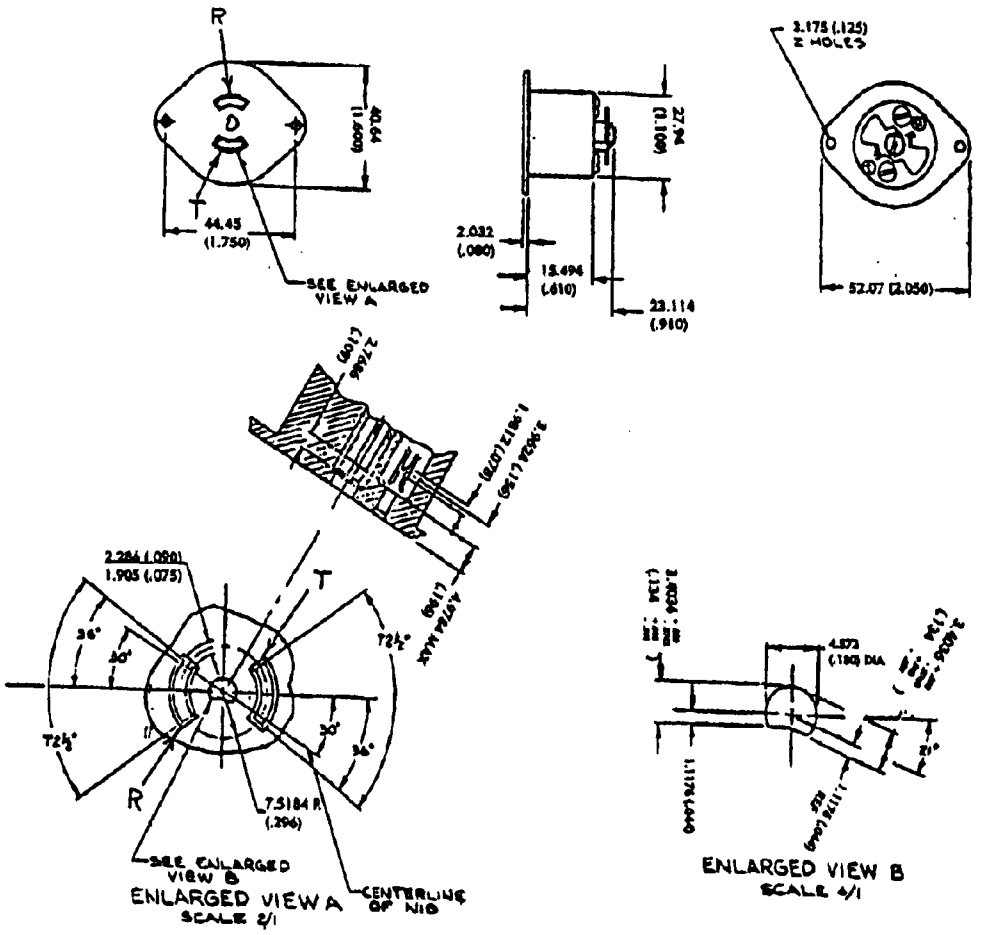
Figure 68.500(h)--3 Position Plug Detail
(Ed. 7/77)
(i) *Miniature 8-position plug, keyed:*

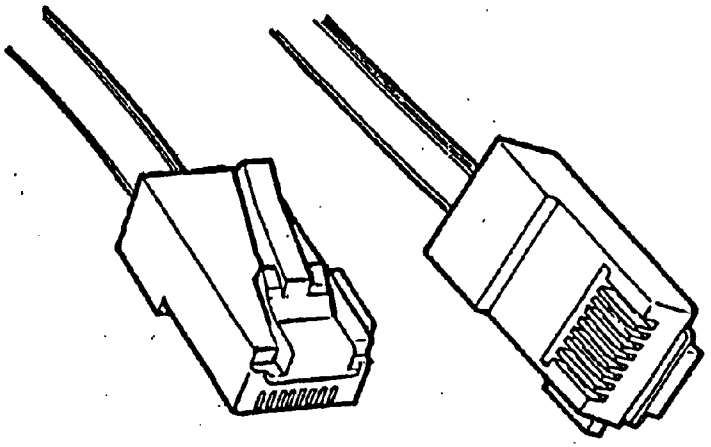
Figure 68.500(i)(1)(i)—View

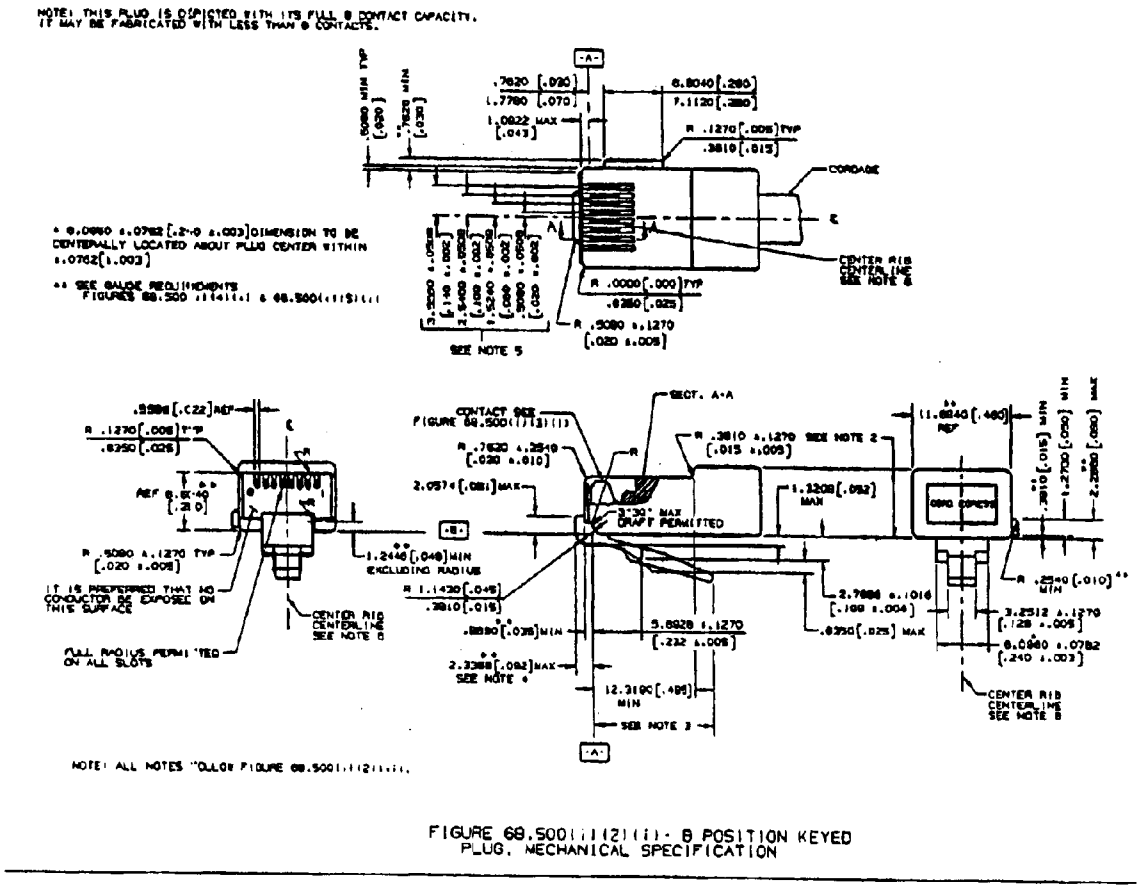
FIGURE 68.500(1)(2)(i)-B POSITION KEYED PLUG, MECHANICAL SPECIFICATION

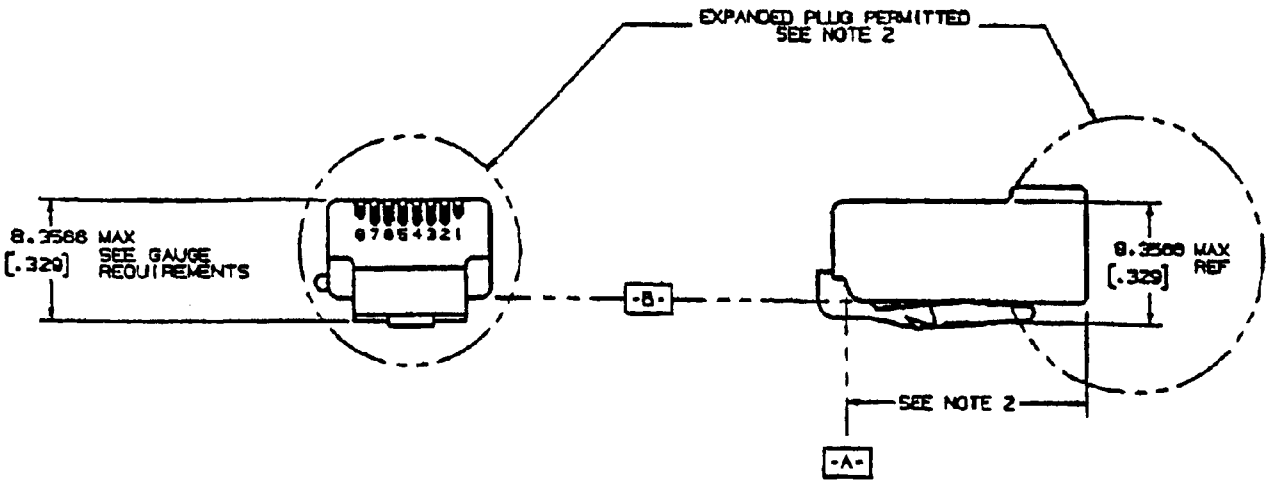
NOTE: ALL NOTES FOLLOW THIS FIGURE
FIGURE 68.500(i)(2)(ii) - 8 POSITION KEYED PLUG, MECHANICAL SPECIFICATION (CONTINUED)
NOTES: (Notes apply to Figures 68.500(i)(2) (i) and 68.500(i)(2)(ii))
1. All plugs must be capable of meeting the requirements of the plug go and no-go gauges.

2. The standard plug height in the area shown is 8.0010 mm (.315 inch) maximum. The standard plug length is 23.1140 mm (.910 inch) maximum. Plugs may be made longer than standard or adapted for direct use on special cords, adapters without cordage, apparatus or equipment subject to the limitations described in the introductory paragraphs of 68.500. Plugs longer and/or higher than standard may inhibit the special features of some network jack enclosures.
3. A 14.6050 mm (.575 inch) minimum tab length is required. It is preferred that maximum tab length be no longer than 15.8750 mm (.625 inch). Longer tabs may be used with the same limitations described in Note 2.
4. To obtain maximum plug guidance in jacks, it is desirable to extend the front plug nose to the 2.3368 mm (.092 inch) maximum.
5. These dimensions apply to the location of jack contact receiving slots. It is desirable that plug contacts be centered axially in these slots, but centering is not required.
6. The center rib centerline shall be coincident with the plug width, 11.6840 mm ref (.460 inch ref.) center line within ± .0762 mm (± .003 inch).

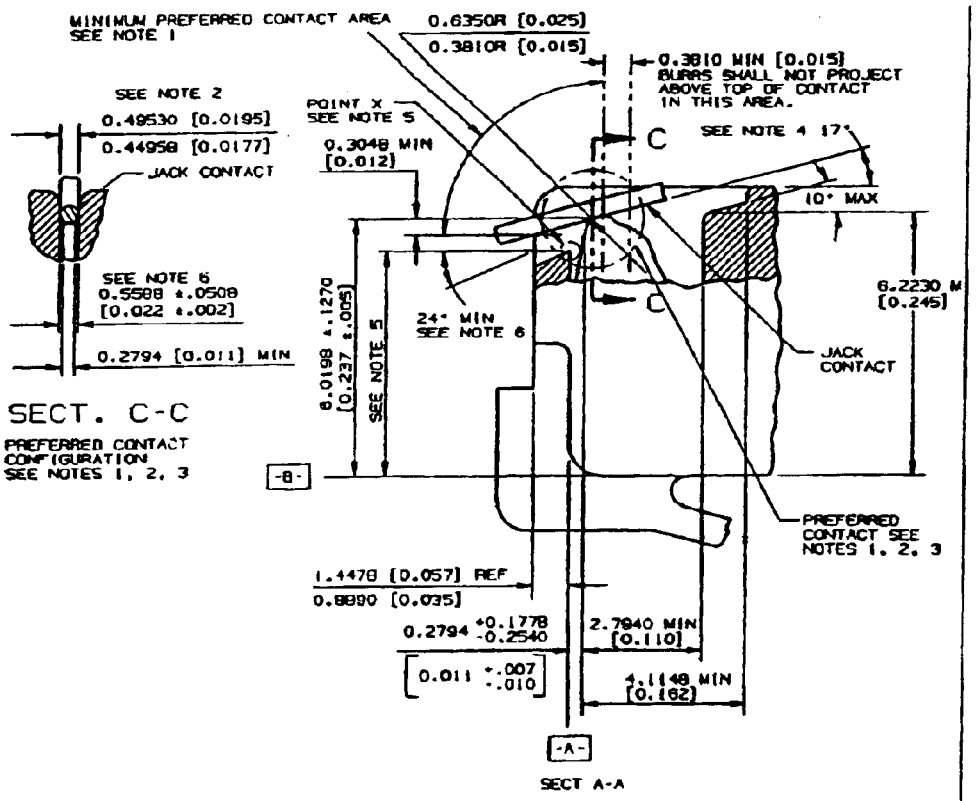

NOTE: ALL NOTES FOLLOW THIS FIGURE.

NOTE: THE 6 POSITION PLUG/JACK CONTACT SPECIFICATION IS IDENTICAL.

FIGURE 68.500(i)(3)(i)- 8 POSITION KEYED PLUG PLUG /JACK CONTACT SPECIFICATION

NOTES: (Notes apply to Figure 68.500(i)(3)(i))

1. The plug/jack contact interface should be hard gold to hard gold and should have a minimum gold thickness of .0012700mm (.000050 inch) on each side of the interface. The minimum contact force should be .98 N (100 grams). Any non-gold contact material must be compatible with gold and provide equivalent contact performance. A smooth, burr-free surface is required at the interface in the area shown.
2. The jack contact design is based upon .4572 mm (.018 inch) spring temper phosphor bronze round wire in the modular plug blade and jack contact interface. Other contact configurations that provide contact performance equal to or better than the preferred configurations and do not cause damage to the plug or jack are permitted. The preferred jack contact width is .44958/.49530 mm (.0177/.0195 inches). Deviations from the preferred jack contact width are permitted for round contacts as well as noncircular cross sectional shapes but they must be compatible with existing plug configurations. The requirements of Note 1 apply to all possible contact areas.
3. The configuration of the plug contact and the front plastic of the plug should prevent jack contacts from being damaged during plug insertion into jacks.
4. This is the suggested nominal contact angle between plugs and jacks with the plug latched into the jack. If this angle becomes greater than 24 degrees loss of electrical contact may occur between the plug and jack. If the nominal contact angle becomes less than 13 degrees, interference between jack contacts and the internal plastic in the plug may occur.
5. To avoid loss of electrical contact, the preferred dimension from "Datum B" to the highest point "X" should be 5.0800 mm (.200 inch) max. A dimension greater than 5.3594 mm (.211 inch) may result in loss of electrical contact between plugs and jacks. The 5.3594 mm (.211 inch) max. shall be considered an absolute maximum.
6. The 25 degree min. angle applies only to plugs with front plastic walls higher than 4.8260 mm (.190 inches).

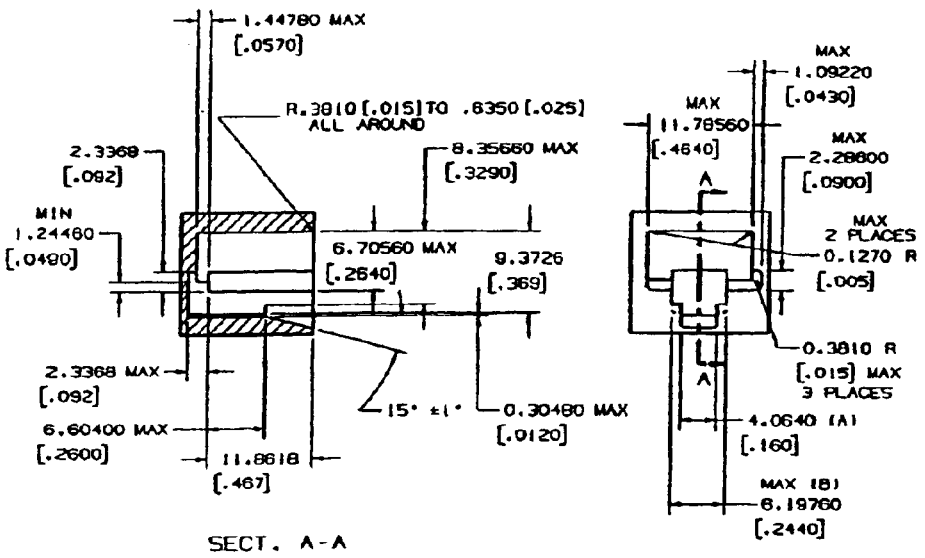

GO GAUGE

NOTES:

1. THE PLUG SHALL BE CAPABLE OF INSERTION AND LATCHING INTO THE GAUGE WITH 22.24 newtons [5 POUNDS] OR LESS INSERTION FORCE. PLUG LATCHING BAR SHALL BE DEPRESSED SO AS NOT TO INTERFERE WITH THE PLUG ENTRY. AFTER INSERTION AND LATCHING, PLUG SHALL BE CAPABLE OF REMOVAL, WITH THE LATCH DEPRESSED, WITH A REMOVAL FORCE OF 44.48 newtons [10 POUNDS] OR LESS APPLIED AT AN ADVANTAGEOUS ANGLE.

2. DIMENSIONS GIVEN TO FOUR DECIMAL PLACES SHALL BE WITHIN ±.0508mm [.002].

3. DIMENSIONS (A) AND (B) TO BE CENTRALLY LOCATED WITH RESPECT TO 11.78560mm [.4640] MAX. JACK OPENING WIDTH WITHIN ±.0254mm[.001].

4. DO NOT SCALE DRAWINGS FOR EXTERNAL CONFIGURATION.

FIGURE 68.500(1)(4)(1)-8 POSITION KEYED PLUG
MAXIMUM PLUG SIZE

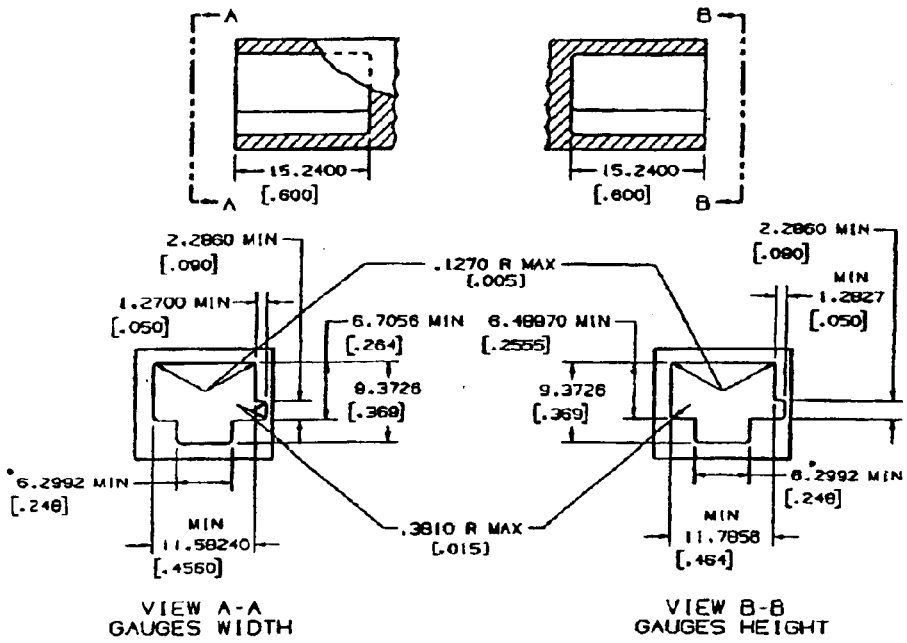

NO-GO GAUGE

NOTES:

1. THE PLUG SHALL NOT BE CAPABLE OF ENTERING THE GAUGE MORE THAN 1.7780mm [.070] BEYOND DATUM-A- (SEE FIGURE 68.500(1)(2)(i) WITH 8.90 newton [2.0 POUNDS] INSERTION FORCE.
2. NON-TOLERANCED DIMENSIONS GIVEN TO FOUR PLACES SHALL BE WITHIN ±.0508mm [.002].
3. *6.2992mm [.248] DIMENSION TO BE CENTRALLY LOCATED WITH RESPECT TO 11.7856mm [.464] MINIMUM AND 11.58240mm [.4560] MINIMUM WITHIN ±.0508mm [.002].

FIGURE 68.500(1)(5)(i)-8 POSITION KEYED PLUG. MINIMUM PLUG SIZE (j) *Miniature 8-position keyed jack:*

Figure 68.500(j)(1)--View
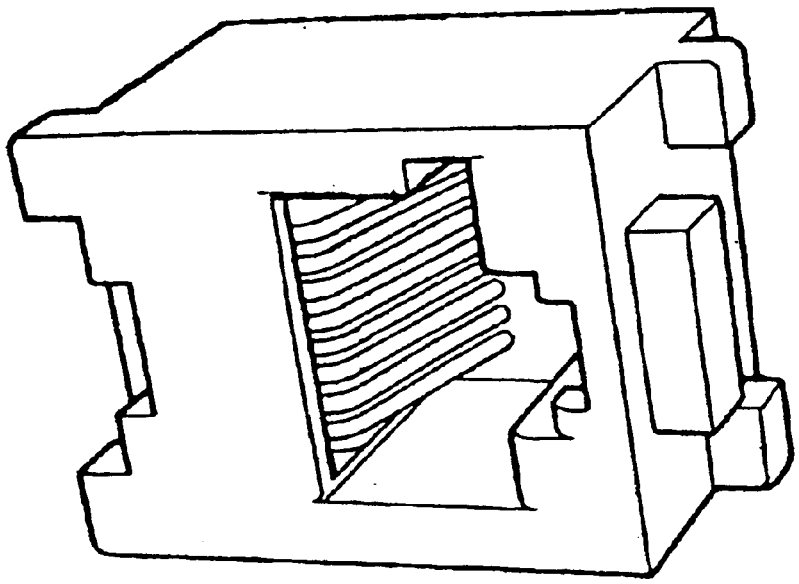

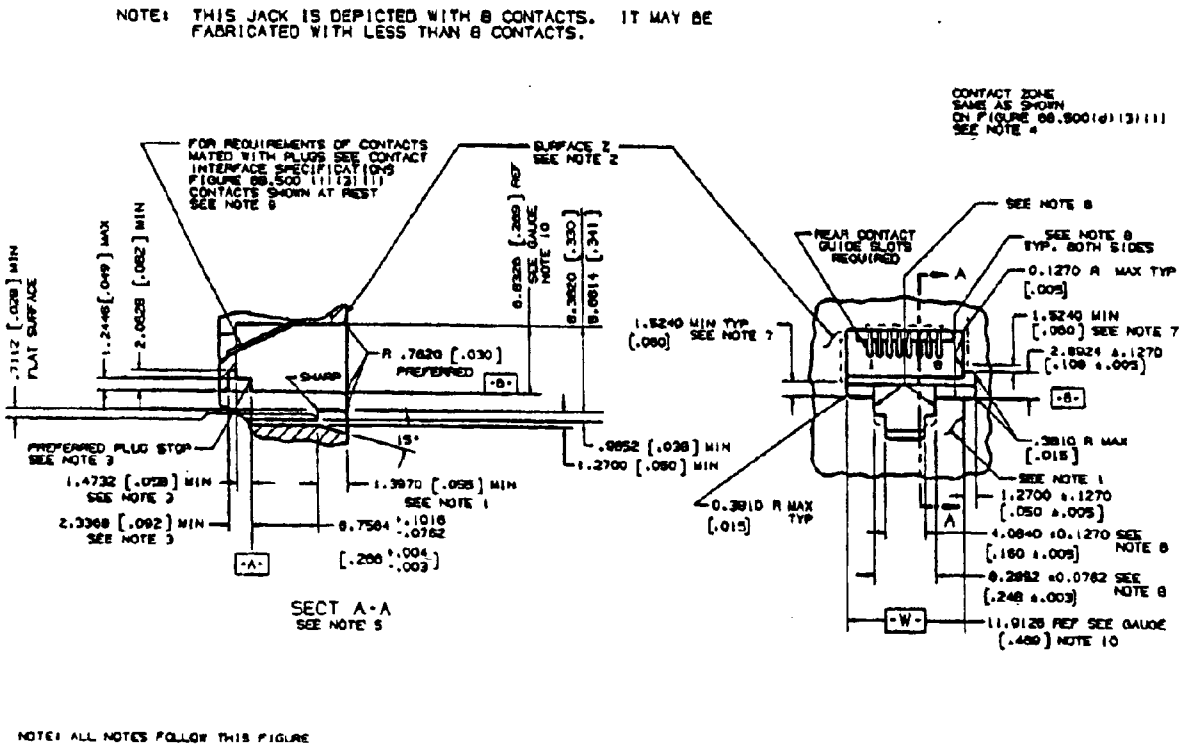

FIGURE 68.500(j)(2)(i)-8 POSITION KEYED JACK MECHANICAL SPECIFICATION

NOTES: (Notes apply to Figure 68.500(j)(2)(i))

1. Front surface projections beyond the 1.3970 mm (.055 inch) minimum shall be configured so as not to prevent finger access to the plug release catch (Reference Figure 68.500(i)(2)(ii) and 8-Position Plug. Mechanical Specifications). A catch length greater than 1.3970 mm (.055 inch) is beneficial in providing for greater breakout strength and improved guidance when interfacing with a 6-position plug.

2. Surface Z need not be planar or coincident with the surface under the plug release catch. Surface Z projections must not prevent insertion, latching, and unlatching of the standard 8-position plug on Figure 68.500(i)(2)(i).
3. The preferred plug stop surface is indicated. If some other internal feature is used as a plug stop, it must be located so that the axial movement of a latched plug is no greater than 1.1430 mm (.045) inch.
4. To prevent mistargeting between the plug and jack contacts, the jack contacts should be completely contained in their individual contact zones, (.7112 mm (.028 inch) max wide), where they extend into the jack openings. There is no location requirement for jack contacts below these zones (5.8420 mm (.230 inch) max), but adequate contact separation must be maintained to prevent electrical breakdown. These shaded contact zones should be centrally located, (include all locating tolerances), about the jack opening width 11.9126 mm (.469 inch) Ref, (Datum-W-). Contacts located outside of these zones may result in mistargeting between the jack and plug contacts.
5. All inside and outside corners in the plug cavity to be .3810 mm (.015 inch) radius max unless specified.
6. These surfaces shall have 0°15′ maximum draft.
7. Relief inside the dotted areas on both sides of the jack opening is permitted. The 6.8326 mm (.269 inch) Ref and 11.9126 mm (.469 inch) Ref Gauge Requirements must be maintained in each of the corners indicated, (Ref. 1.5240 mm (.060 inch) min), to assure proper plug/jack interface guidance.
8. 4.0640 mm (.160 inch) and 6.2992 mm (.248 inch) dimensions to be centrally located to jack opening width -W- within ±.1270 mm (.005).
9. The contact lengths shall be such that the contacts will always be contained inside the guide slots and the contacts must move freely in the slots so as not to restrain plug insertion or damage jack contacts.
10. Gauge Requirements:

GO: The jack shall be capable of accepting and 11.78560 × 6.70560 mm (.4640 × .2640 inch) gauge and the gauge shall be capable of being removed with a maximum force of 8.9 newtons (2.0 pounds).

NO GO: The jack shall not accept either a 12.03960 × 6.4516 mm (.4740 × .254 inch) horizontal width of opening gauge or a 6.95960 × 11.5824 mm (.2740 × .456 inch) vertical height of opening gauge. However, if the gauge is accepted, the force necessary to remove the gauge shall be minimum of .83 newtons (3.0 ounces).

Removal forces do not include forces contributed by contact springs nor shall external forces be applied to the jack that will affect these removal forces.

Gauges shall have a .7620 mm (.030 inch) radius on the nose and a .3810 mm (.015 inch) radius on all edges with clearance provided for contracts.

[41 FR 28699, July 12, 1976, as amended at 45 FR 52151, Aug. 6, 1980; 50 FR 27251, July 2, 1985; 58 FR 44907, Aug. 25, 1993; 62 FR 36465, July 8, 1997]

§ 68.502 Configurations.

This section describes connection configurations which telephone subscribers may request their local telephone company to provide, in accordance with § 68.104 of these rules. In the absence of a request for a specific jack configuration, the telephone company shall install the standard jack depicted in § 68.502(a)(1). The listed configurations are for connections to be made by the telephone company to the standard jacks specified in this subpart. Plugs on registered terminal equipment and registered protective circuitry shall be wired so as to be compatible with the jack connections specified herein. The following nomenclature is used in this section:

T/R—Connections to the "tip" and "ring" wires of a telephone communications line, trunk, channel or facility.

A/A1—Connections to the "hold" functions of key telephone systems which use such connections. In such systems, the "A" lead corresponding to a particular telephone line is shorted to the "A1" lead when that line is placed in the "off-hook" state to permit proper operation of the "hold" functions associated with that line.

MB/MB1—Connections to leads implementing a make-busy feature where required. The MB lead is shorted by the terminal equipment to the MB1 lead when the corresponding telephone line is to be placed in an unavailable, or artificially busy condition.

Bridged—A bridged connection is a parallel connection.

Data—Data configurations are those which use jacks incorporating components to limit signal power levels of data equipment. Data equipment with a maximum signal power output of −9 dBm may be connected to other than data configurations. *See* § 68.308 of these rules.

A "USOC" (Universal Service Ordering Code) is specified for each configuration. These USOCs are generic telephone company service ordering codes. If a telephone subscriber wishes to

What is claimed is:

1. A modular jack connector assembly comprising:

a dielectric housing having a front face and a rear face, said front face defining at least two receptacles adapted for receiving a mating plug, said rear face defining a transverse slot for receiving an edge of a circuit board;

a plurality of contacts disposed in said housing, each contact having a first free end and a second free end and being secured to said housing at a point between said first and second free ends, each contact having a plug engaging portion and a connection portion, said plug engaging portion of each contact extending forward in at least one of said receptacles from said point to said free end such that said plug engaging portion electrically connects with a mating plug when the mating plug is received within said at least of said receptacles, said connection portion of each contact extending from said point into said slot toward said second free end such that said connection portion contacts the circuit board when said housing is mounted to a circuit board.

2. The assembly of claim 1, wherein said contacts have a normal force less than about 50 g.

3. The assembly of claim 1, wherein the thickness of said contacts is about 0.005 to about 0.014" and the width of said contacts is about 0.014 and about 0.016".

4. The assembly of claim 1, wherein each contact consists essentially of said first free end connected to an upwardly angled section, said upwardly angled section being connected to an elongated arm portion, said elongated arm portion being connected to said connection portion.

5. The assembly of claim 4, wherein said connection portion is curved around a rear portion of said housing to anchor said contact in said housing.

6. The assembly of claim 4, wherein said upwardly angled section extends from said first free end at an angle about 30 to 45 degrees from a lower wall of said housing, and said elongated arm portion extends from said upwardly angled section at an angle of between about 5 to 15 degrees from said lower wall.

7. A modular jack connector assembly comprising:

a dielectric housing having a front face and a rear face, said front face defining at least one receptacle adapted for receiving a mating plug that conforms to the RJ standard, said rear face defining a transverse slot for receiving an edge of a circuit board;

a plurality of contacts disposed in said housing, each contact having a first free end and a second free end and being secured to said housing at a point between said first and second free ends, each contact having a plug engaging portion and a connection portion, said plug engaging portion of each contact extending forward in said receptacle from said point to said free end such that said plug engaging portion electrically connects with a mating plug when the mating plug is received within said receptacle, said connection portion of each contact extending from said point into said slot toward said second free end such that said connection portion contacts the circuit board when said housing is mounted to a circuit board.

8. The assembly of claim 7, wherein said contacts have a normal force which is about 30% to about 80% below the RJ-standard for normal force.

9. The assembly of claim 7, wherein said receptacle is configured to receive plugs that conform to the RJ-11 standard.

10. The assembly of claim 7, wherein said housing comprises one receptacle.

11. The assembly of claim 7, wherein said housing comprises two or more receptacles.

12. The assembly of claim 7, wherein said contacts are less thick and more narrow than those conforming to RJ-standards.

13. The assembly of claim 12, wherein the thickness of said contacts is about 25 to about 75% below that required under the RJ-standards, and the width of said contacts is about 5 to about 15% below that required under RJ-standards.

14. The assembly of claim 7, wherein said receptacle is configured to receive plugs that conform to the RJ-45 standard.

15. The assembly of claim 14, wherein said contacts are sufficiently compliant such that if an RJ-11 plug is inserted fully into said receptacle, the elastic limit of said contacts is not exceeded.

16. The assembly of claim 7, wherein each contact consists essentially of said first free end connected to an upwardly angled section, said upwardly angled section being connected to an elongated arm portion, said elongated arm portion being connected to said connection portion.

17. The assembly of claim 16, wherein said connection portion is curved around a rear portion of said housing to anchor said contact in said housing.

18. The assembly of claim 16, wherein said upwardly angled section extends from said first free end at an angle about 30 to 45 degrees from a lower wall of said housing, and said elongated arm portion extends from said upwardly angled section at an angle of between about 5 to 15 degrees from said lower wall.

19. A PCMCIA card comprising:

a card housing;

a circuit board mounted in said card housing; and a modular jack connector assembly card-edge connected to said circuit board, said modular jack assembly comprising:

a dielectric housing having a face and a rear face, said front face defining at least one receptacle adapted for receiving a mating plug, said rear face defining a transverse slot for receiving an edge of a circuit board; and a plurality of contacts disposed in said housing, each contact having a first free end and a second free end and being secured to said housing at a point between said first and second free ends, each contact having a plug engaging portion and a connection portion, said plug engaging portion of each contact extending forward in said receptacle from said point to said first free end such that said plug engaging portion electrically connects with a mating plug when the mating plug is received within said receptacle, said connection portion of each contact extending from said point into said slot toward said second free end such that said connection portion contacts the circuit board when said housing is mounted to a circuit board.

20. The assembly of claim 19, wherein said contacts have a normal force less than about 50 g.

21. The assembly of claim 19, wherein the thickness of said contacts is about 0.005 to about 0.014" and the width of said contacts is about 0.014 and about 0.016".

22. The assembly of claim 19, wherein said housing comprises one receptacle.

23. The assembly of claim 19, wherein said housing comprises two or more receptacles.

24. The assembly of claim 19, wherein each contact consists essentially of said first free end connected to an upwardly angled section, said upwardly angled section being connected to an elongated arm portion, said elongated arm portion being connected to said connection portion.

25. The assembly of claim 24, wherein said connection portion is curved around a rear portion of said housing to anchor said contact in said housing.

26. The assembly of claim 24, wherein said upwardly angled section extends from said first free end at an angle about 30 to 45 degrees from a lower wall of said housing, and said elongated arm portion extends from said upwardly angled section at an angle of between about 5 to 15 degrees from said lower wall.

27. A modular jack connector assembly comprising:

a dielectric housing having a front face and a rear face, said front face defining at least one receptacle adapted for receiving a mating plug, said rear face defining a transverse slot for receiving an edge of a circuit board a plurality of contacts disposed in said housing, each contact having a first free end and a second free end and being secured to said housing at a point between said first and second free ends, each contact having a plug engaging portion and a connection portion, said plug engaging portion of each contact extending forward in said receptacle from said point to said free end such that said plug engaging portion electrically connects with a mating plug when the mating plug is received within said receptacle, said connection portion of each contact extending from said point into said slot toward said second free end such that said connection portion contacts the circuit board when said housing is mounted to a circuit board, wherein each contact consists essentially of said first free end connected to an upwardly angled section, said upwardly angled section being connected to an elongated arm portion, said elongated arm portion being connected to said connection portion.

28. The assembly of claim 27, wherein said connection portion is curved around a rear portion of said housing to anchor said contact in said housing.

29. The assembly of claim 27, wherein said upwardly angled section extends from said first free end at an angle about 30 to 45 degrees from a lower wall of said housing, and said elongated arm portion extends from said upwardly angled section at an angle of between about 5 to 15 degrees from said lower wall.

30. The assembly of claim 27, wherein said contacts have a normal force less than about 50 g.

31. The assembly of claim 27, wherein the thickness of said contacts is about 0.005 to about 0.014" and the width of said contacts is about 0.014 and about 0.016".

32. The assembly of claim 27, wherein said housing comprises one receptacle.

33. The assembly of claim 27, wherein said housing comprises two or more receptacles.

* * * * *